US010184338B2

(12) United States Patent
Siegrist et al.

(10) Patent No.: US 10,184,338 B2
(45) **Date of Patent: *Jan. 22, 2019**

(54) ROOF SUPPORT MONITORING FOR LONGWALL SYSTEM

(71) Applicant: Joy MM Delaware, Inc., Wilmington, DE (US)

(72) Inventors: Paul M. Siegrist, Brisbane (AU); Nigel J. Buttery, South Brisbane (AU); Kirabo Kiyingi, Queensland (AU)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/669,032

(22) Filed: Aug. 4, 2017

(65) Prior Publication Data

US 2017/0335688 A1 Nov. 23, 2017

Related U.S. Application Data

(63) Continuation of application No. 14/839,581, filed on Aug. 28, 2015, now Pat. No. 9,739,148.
(Continued)

(51) Int. Cl.
*E21F 17/18* (2006.01)
*E21D 23/06* (2006.01)
*E21D 23/12* (2006.01)

(52) U.S. Cl.
CPC ..... *E21F 17/185* (2013.01); *E21D 23/066* (2013.01); *E21D 23/12* (2013.01)

(58) Field of Classification Search
CPC ..... E21D 23/066; E21D 23/12; E21F 17/185
(Continued)

(56) References Cited

U.S. PATENT DOCUMENTS 3,922,015 A 11/1975 Poundstone
4,008,921 A 2/1977 Czaudema et al.
(Continued)

FOREIGN PATENT DOCUMENTS

CN 1916367 2/2007
CN 201117080 9/2008
(Continued)

OTHER PUBLICATIONS

Search Report from the Turkish Patent Office for Application No. 2015/10594 dated Apr. 10, 2017 (6 pages).
(Continued)

*Primary Examiner* — Daniel Previl
(74) *Attorney, Agent, or Firm* — Michael Best & Friedrich LLP

(57) ABSTRACT

A monitoring device and method for monitoring a longwall mining system having a roof support, the roof support including a pressure sensor to determine pressure levels of the roof support during a monitoring cycle. Pressure information is obtained for the roof support. An electronic processor then determines whether the pressure information is indicative of a first type of pressure failure of the roof support and whether the pressure information is indicative of a second type of pressure failure of the roof support. An alert is generated in response to determining that the pressure information is indicative of at least one selected from the group consisting of the first type of pressure failure and the second type of pressure failure.

16 Claims, 20 Drawing Sheets

Related U.S. Application Data

(60) Provisional application No. 62/043,389, filed on Aug. 28, 2014.

(58) Field of Classification Search
USPC .. 340/566, 657, 538.12, 538.13, 568.8, 571, 340/572.1, 573.7, 588, 589, 691.6, 692, 340/3.43, 3.44, 825.23
See application file for complete search history.

(56) References Cited

U.S. PATENT DOCUMENTS

| | | | | |
|---|---|---|---|---|
| 4,079,997 | A | 3/1978 | Bienko et al. | |
| 4,085,971 | A | 4/1978 | Jacoby | |
| 4,143,552 | A | 3/1979 | Godfrey | |
| 4,146,271 | A | 3/1979 | Ward | |
| 4,192,551 | A | 3/1980 | Weimer et al. | |
| 4,200,335 | A | 4/1980 | Moynihan et al. | |
| 4,323,280 | A | 4/1982 | Lansberry et al. | |
| 4,581,712 | A * | 4/1986 | Perry | G01L 5/243 299/1.05 |
| 4,753,484 | A | 6/1988 | Stolarczyk et al. | |
| 4,870,364 | A | 9/1989 | Trox et al. | |
| 5,268,683 | A * | 12/1993 | Stolarczyk | E21C 35/24 175/40 |
| 5,425,601 | A * | 6/1995 | Calandra, Jr. | E21C 41/16 405/259.1 |
| 5,448,479 | A | 9/1995 | Kemner et al. | |
| 5,469,356 | A | 11/1995 | Hawkins et al. | |
| 5,542,788 | A * | 8/1996 | Stankus | E21C 41/16 33/1 H |
| 5,586,030 | A | 12/1996 | Kemner et al. | |
| 5,615,116 | A | 3/1997 | Gudat et al. | |
| 5,646,845 | A | 7/1997 | Gudat et al. | |
| 5,648,901 | A | 7/1997 | Gudat et al. | |
| 5,838,562 | A | 11/1998 | Gudat et al. | |
| 5,877,723 | A | 3/1999 | Fan et al. | |
| 5,906,646 | A | 5/1999 | Kemner | |
| 5,913,914 | A | 6/1999 | Kemner et al. | |
| 5,925,081 | A | 7/1999 | Hawkins et al. | |
| 5,956,250 | A | 9/1999 | Gudat et al. | |
| 5,961,560 | A | 10/1999 | Kemner | |
| 5,967,616 | A | 10/1999 | Offutt et al. | |
| 6,002,362 | A | 12/1999 | Gudat | |
| 6,132,005 | A | 10/2000 | Mazlin et al. | |
| 6,351,697 | B1 | 2/2002 | Baker | |
| 6,361,119 | B1 | 3/2002 | Kussel | |
| 6,393,362 | B1 | 5/2002 | Burns | |
| 6,442,456 | B2 | 8/2002 | Burns et al. | |
| 6,612,655 | B2 * | 9/2003 | Schwoebel | E21C 27/24 299/29 |
| 6,633,800 | B1 | 10/2003 | Ward et al. | |
| 6,666,521 | B1 | 12/2003 | Pease et al. | |
| 6,694,233 | B1 | 2/2004 | Duff et al. | |
| 6,799,100 | B2 | 9/2004 | Burns et al. | |
| 7,181,370 | B2 | 2/2007 | Furem et al. | |
| 7,574,821 | B2 | 8/2009 | Furem | |
| 7,578,079 | B2 | 8/2009 | Furem | |
| 7,656,342 | B2 | 2/2010 | Stolarczyk et al. | |
| 7,659,847 | B2 | 2/2010 | Bausov et al. | |
| 7,695,071 | B2 | 4/2010 | Jackson et al. | |
| 7,725,232 | B2 | 5/2010 | Makela et al. | |
| 7,899,599 | B2 | 3/2011 | Makela et al. | |
| 8,723,673 | B2 * | 5/2014 | Meiksin | F16B 31/02 340/566 |
| 9,739,148 | B2 * | 8/2017 | Siegrist | E21F 17/185 |
| 2007/0216216 | A1 * | 9/2007 | Baird, Jr. | E21C 27/24 299/1.05 |
| 2009/0063739 | A1 | 3/2009 | Weddle | |
| 2010/0098509 | A1 * | 4/2010 | Melic | F16B 13/0891 411/26 |
| 2010/0114808 | A1 | 5/2010 | Mintah | |
| 2010/0138094 | A1 | 6/2010 | Stark et al. | |
| 2011/0153541 | A1 | 6/2011 | Koch et al. | |
| 2012/0146387 | A1 * | 6/2012 | Shatters | B65G 41/008 299/1.9 |
| 2012/0191431 | A1 | 7/2012 | Dunbabin et al. | |
| 2012/0305025 | A1 | 12/2012 | Helbig et al. | |
| 2013/0006484 | A1 | 1/2013 | Avitzur et al. | |

FOREIGN PATENT DOCUMENTS

| | | |
|---|---|---|
| CN | 101333927 | 12/2008 |
| CN | 102235172 | 11/2011 |
| CN | 2022544888 | 11/2012 |
| CN | 103244184 | 8/2013 |
| CN | 205260036 | 5/2016 |
| PL | 189946 | 10/2005 |
| PL | 201259 | 3/2009 |
| PL | 406294 | 6/2015 |

OTHER PUBLICATIONS

Search Report from the Polish Patent Office for Application No. P-413692 dated Mar. 15, 2016 (2 pages).

Australian First Examination Report for Application No. 2015218547 dated Mar. 21, 2018 (3 pages).

Office Action from the Chinese Patent Office for related Application No. 201510542683.8 dated Jul. 16, 2018 (12 pages including Statement of Relevance).

* cited by examiner

ROOF SUPPORT MONITORING FOR LONGWALL SYSTEM

RELATED APPLICATIONS

The present application is a continuation of U.S. patent application Ser. No. 14/839,581 published as U.S. Patent Publication No. 2016/0061036, which claims priority to U.S. Provisional Patent Application No. 62/043,389 and is related to co-filed U.S. patent application Ser. No. 14/839,599 published as U.S. Patent Publication No. 2016/0061035, the entire contents of all of which are incorporated herein by reference.

FIELD OF THE INVENTION

The present invention relates to monitoring roof supports of a longwall mining system.

SUMMARY

Longwall mining begins with identifying a coal seam to be mined, then "blocking out" the seam into coal panels by excavating roadways around the perimeter of each panel. During excavation of the seam, select pillars of coal can be left unexcavated between adjacent coal panels in order to assist in supporting the overlying geological strata. The coal panels are excavated by a longwall mining system, which includes components such as automated electro-hydraulic roof supports, a coal shearing machine (i.e., a longwall shearer), and an armored face conveyor (i.e., AFC) parallel to the coal face. As the shearer travels the width of the coal face, removing a layer of coal, the roof supports automatically advance to support the roof of the newly exposed section of strata. The AFC is then advanced by the roof supports toward the coal face by a distance equal to the depth of the coal layer previously removed by the shearer. Advancing the AFC toward the coal face in such a manner allows the shearer to engage with the coal face and continue shearing coal away from the face.

In one embodiment, the invention provides a method of monitoring roof supports of a longwall mining system. The method includes a processor obtaining roof support pressure data aggregated over a monitoring cycle. The processor analyzes the pressure data to determine whether a pressure failure occurred for each roof support during the monitoring cycle. The method further includes generating a fault quantity indicating the number of roof supports determined to have experienced the pressure failure. An alert is then generated upon determining that the fault quantity exceeds an alert threshold.

In another embodiment, the invention provides a system for monitoring a longwall mining system. The system includes multiple roof supports, and each roof support includes a single or multiple pressure sensors to determine pressure levels of the roof support over a monitoring cycle. The system also includes a monitoring module implemented on a processor that communicates with the roof supports to receive pressure data and the determined pressure levels. The monitoring module includes an analysis module, a tally module, and an alert module. The analysis module analyzes the pressure data to determine whether a pressure failure occurred during the monitoring cycle for each roof support. The tally module generates a fault quantity representing the number of roof supports determined to have had the pressure failure during the monitoring cycle. The alert module generates an alert upon determining that the fault quantity exceeds an alert threshold.

Other aspects of the invention will become apparent by consideration of the detailed description and accompanying drawings.

DETAILED DESCRIPTION

Figure 1A:
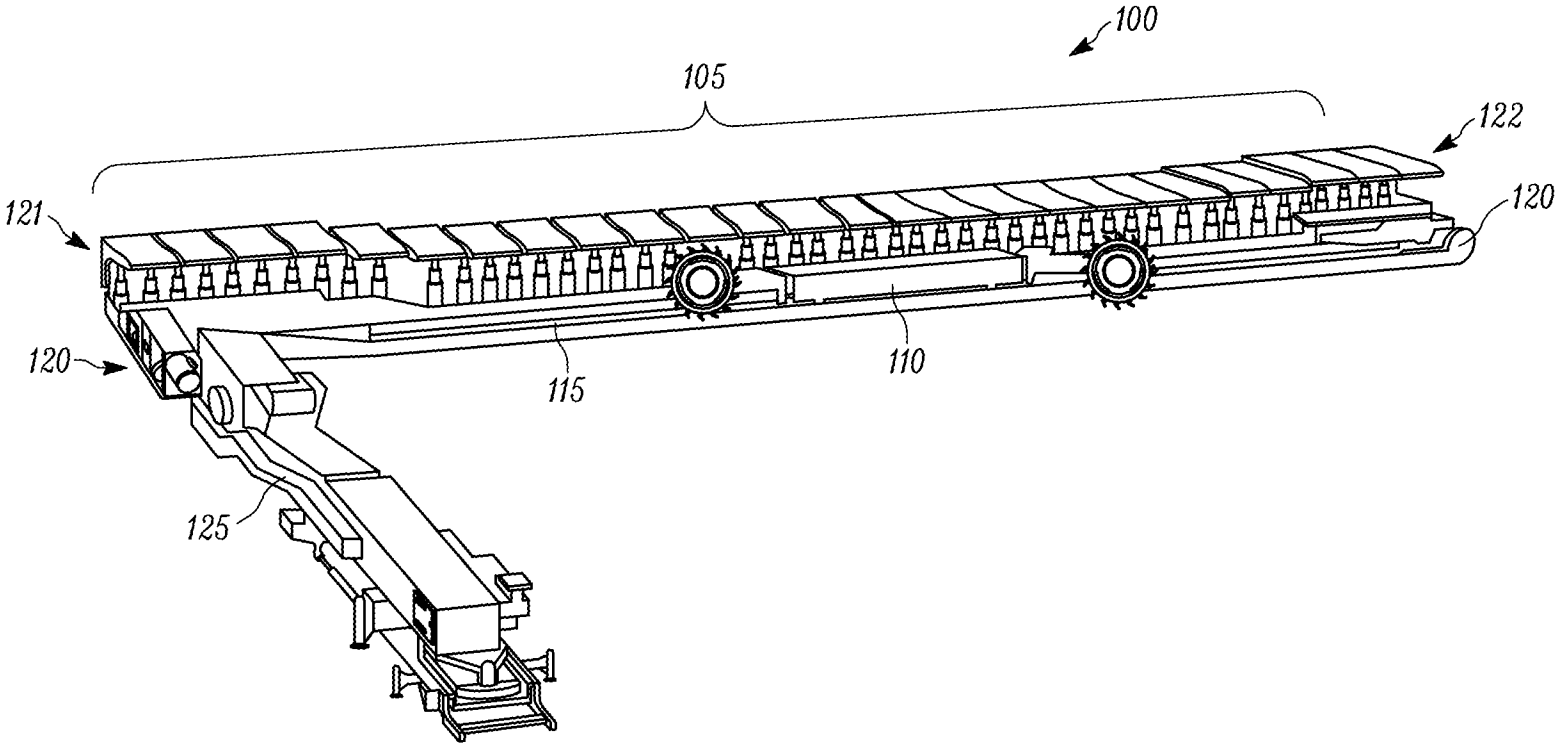
FIGS. 1A-B illustrate a longwall mining system.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. It should also be noted that a plurality of hardware and software based devices, as well as a plurality of different structural components may be used to implement the invention.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it would be noted that a plurality of hardware and software based devices, as well as a plurality of different structural components, may be utilized to implement the invention. Furthermore, and as described in subsequent paragraphs, the specific mechanical configurations illustrated in the drawings are intended to exemplify embodiments of the invention. However, other alternative mechanical configurations are possible. For example, "controllers" and "modules" described in the specification can include standard processing components, such as one or more processors, one or more computer-readable medium modules, one or more input/output interfaces, and various connections (e.g., a system bus) connecting the components. In some instances, the controllers and modules may be implemented as one or more of general purpose processors, digital signal processors (DSPs), application specific integrated circuits (ASICs), and field programmable gate arrays (FPGAs) that execute instructions or otherwise implement their functions described herein.

Figure 1B:
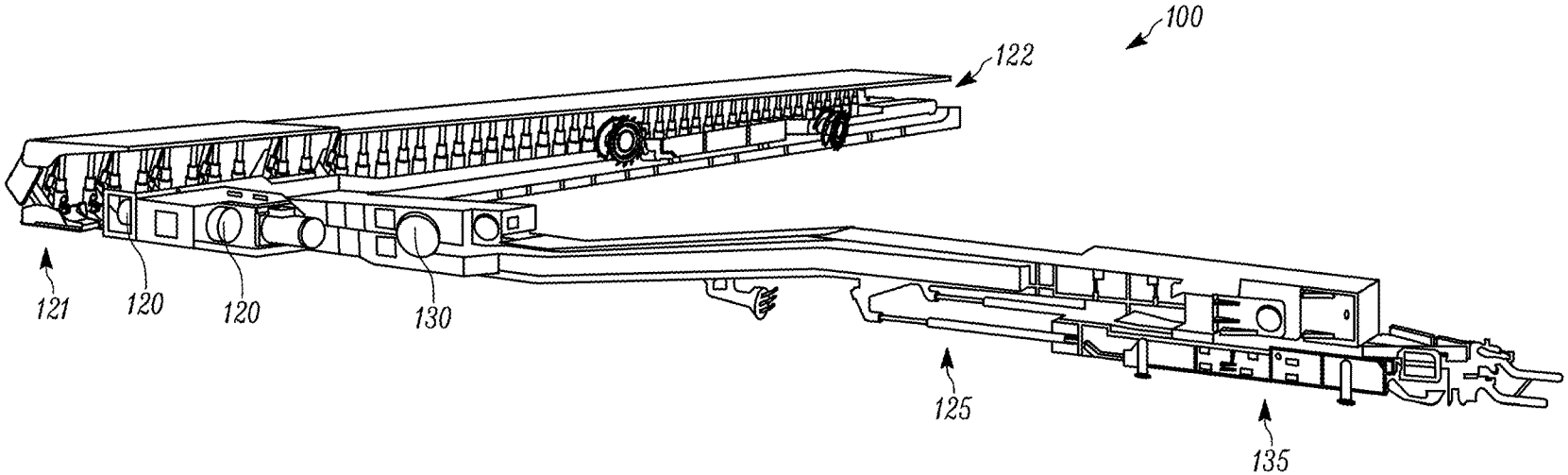

FIGS. 1A-B illustrate a longwall mining system 100. The longwall mining system 100 is configured to extract a product, for example, coal from a mine in an efficient manner. The longwall mining system 100 could also be used to extract other ores or minerals such as, for example, Trona. The longwall mining system 100 physically extracts coal, or another mineral, from an underground mine. The longwall mining system 100 could alternatively be used to physically extract coal, or another mineral, from a seam exposed above-ground (e.g., a surface mine).

As shown in FIG. 1A, the longwall mining system 100 includes roof supports 105 and a longwall shearer 110. The roof supports 105 are interconnected parallel to the coal face (not shown) by electrical and hydraulic connections. Further, the roof supports 105 shield the shearer 110 from the overlying geological strata. The number of roof supports 105 used in the system 100 depends on the width of the coal face being mined, since the roof supports 105 are intended to protect the full width of the coal face from the strata. The shearer 110 propels itself along the line of the coal face on the armored face conveyor (AFC) 115, which has a dedicated track (rack-bars) for the shearer 110 running parallel to the coal face between the face itself and the roof supports 105. The AFC 115 also includes a conveyor parallel to the shearer track, such that excavated coal can fall onto the conveyor to be transported away from the face. The conveyor of the AFC 115 is driven by AFC drives 120 located at a maingate 121 and a tailgate 122, which are at distal ends of the AFC 115. The AFC drives 120 allow the conveyor to continuously transport coal toward the maingate (left side of FIG. 1A), and allows the shearer 110 to be hauled along the track of the AFC 115 bi-directionally across the coal face. In some embodiments, the longwall shearer may be positioned such that the maingate is on the right side and the tailgate is on the left side of the shearer.

The system 100 also includes a beam stage loader (BSL) 125 arranged perpendicularly at its maingate end to the AFC 115. FIG. 1B illustrates a perspective view of the system 100 and an expanded view of the BSL 125. When the won coal hauled by the AFC reaches the maingate, it is routed through a 90° turn onto the BSL 125. In some instances, the BSL 125 interfaces with the AFC 115 at a non-right 90° angle. The BSL 125 then prepares and loads the coal onto a maingate conveyor (not shown), which transports the coal to the surface. The coal is prepared to be loaded by a crusher (or sizer) 130, which breaks down the coal to improve loading onto the maingate conveyor. Similar to the conveyor of the AFC 115, the BSL's 125 conveyor is driven by a BSL drive 135.

Figure 2A:
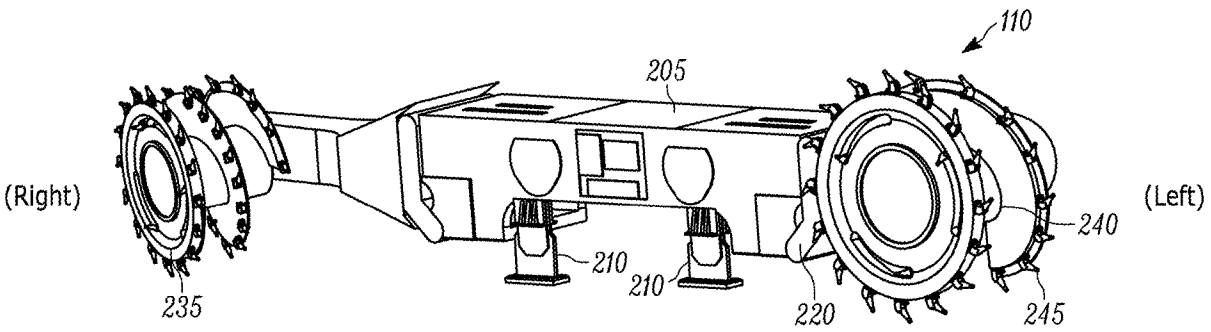
FIGS. 2A-B illustrate a longwall shearer.
Figure 2B:
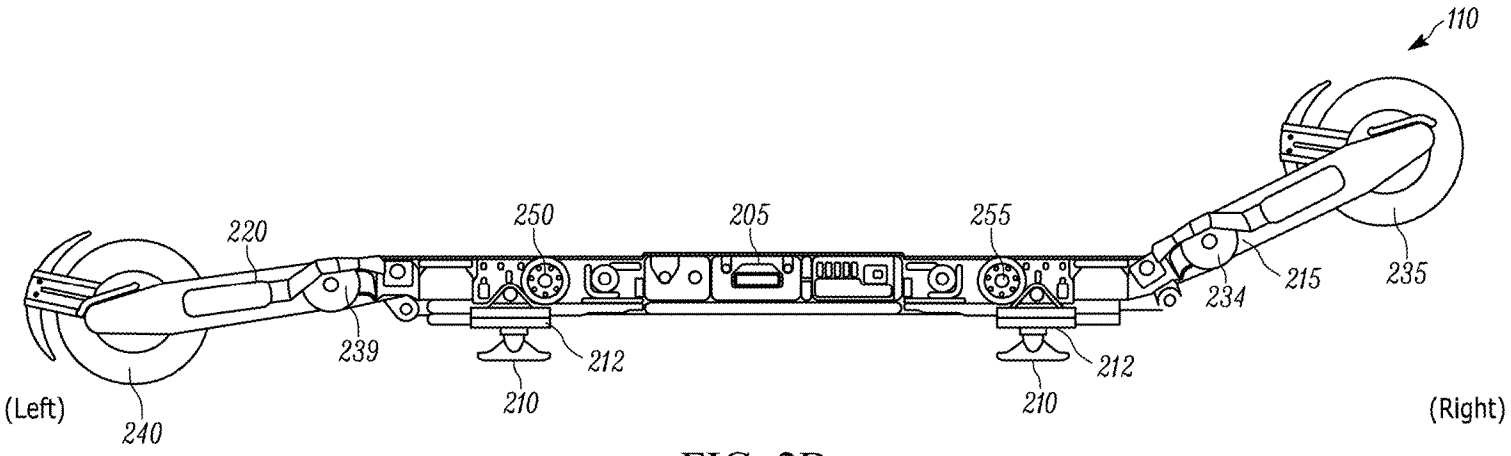

FIGS. 2A-B illustrate the shearer 110. FIG. 2A illustrates a perspective view of the shearer 110. The shearer 110 has an elongated central housing 205 that stores the operating controls for the shearer 110. Extending below the housing 205 are skid shoes 210 (FIG. 2A) and trapping shoes 212 (FIG. 2B). The skid shoes 210 support the shearer 110 on the face side of the AFC 115 (e.g., the side nearest to the coal face) and the trapping shoes 212 support the shearer 110 on the goaf side of the AFC 115. In particular, the trapping shoes 212 and haulage sprockets engage the AFC's 115 track, allowing the shearer 110 to be hauled along the coal face. Extending laterally from the housing 205 are left and right ranging arms 215 and 220, respectively, which are raised and lowered by hydraulic cylinders attached to the under-side of the ranging arms 215, 220 and shearer body 205. On the distal end of the right ranging arm 215 (with respect to the housing 205) is the right cutter drum 235, and on the distal end of the left ranging arm 220 is a left cutter drum 240. The cutter drums are driven by respective electric motors 234, 239 via the gear train within the ranging arm 215,220. Each of the cutters 235,240 have a plurality of mining bits 245 (e.g., cutting picks), which abrade the coal face as the cutter drums 235,240 are rotated, thereby cutting away the coal. The mining bits 245 are also accompanied by spray nozzles that can also spray fluid during the mining process, such as for dispersing noxious and/or combustible gases that develop at the excavation site and for dust suppression and cooling. FIG. 2B illustrates a side view of the shearer 200 including the cutter drums 235,240, ranging arms 215,220, skid shoes 210, trapping shoes 212, haulage sprockets, and housing 205. FIG. 2B also shows detail of a left haulage motor 250 and right haulage motor 255 used to haul the shearer 110 along the track of the AFC 115.

Figure 3:
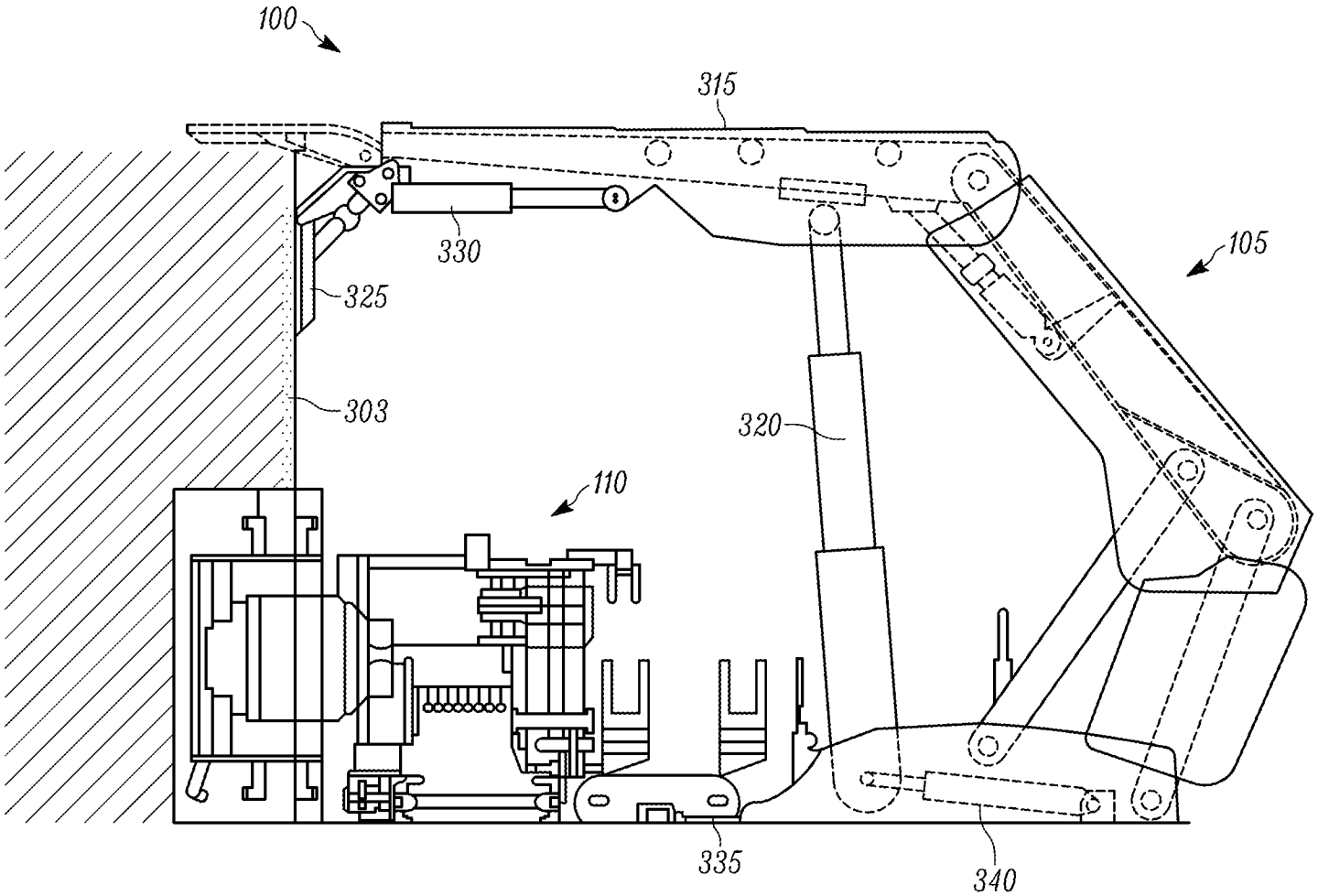
FIG. 3 illustrates a side-view of a powered roof support.
Figure 4:
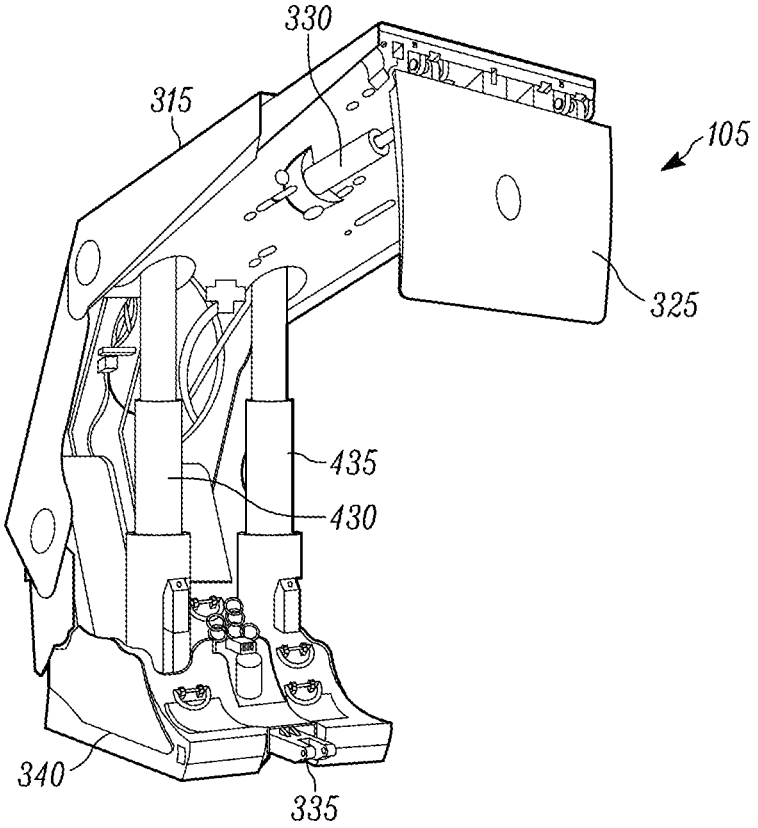
FIG. 4 illustrates an isometric view of the roof support of FIG. 3.

FIG. 3 illustrates the longwall mining system 100 as viewed along the line of a coal face 303. The roof support 105 is shown shielding the shearer 110 from the strata above by an overhanging canopy 315 of the roof support 105. The canopy 315 is vertically displaced (i.e., toward and away from the strata) by hydraulic legs 320 (only one of which is shown in FIG. 3). The canopy 315 can thereby exert a range of upward forces on the geological strata by applying different pressures to the hydraulic legs 320. Mounted to the face end of the canopy 315 is a deflector or sprag 325, which is shown in a face-supporting position. However, the sprag 325 can also be fully extended, as shown in ghost, by a sprag ram 330. An advance ram 335 attached to a base 340 allows the roof support 105 to be advanced toward the coal face 303 as the layers of coal are sheared away. The advance ram 335 also allows the roof supports 105 to push the AFC 115 forward. FIG. 4 illustrates a isometric view of the roof support 105. The roof support 105 is shown having a left hydraulic leg 430 and a right hydraulic leg 435, each containing pressurized fluid, which support the canopy 315.

Figure 5A:
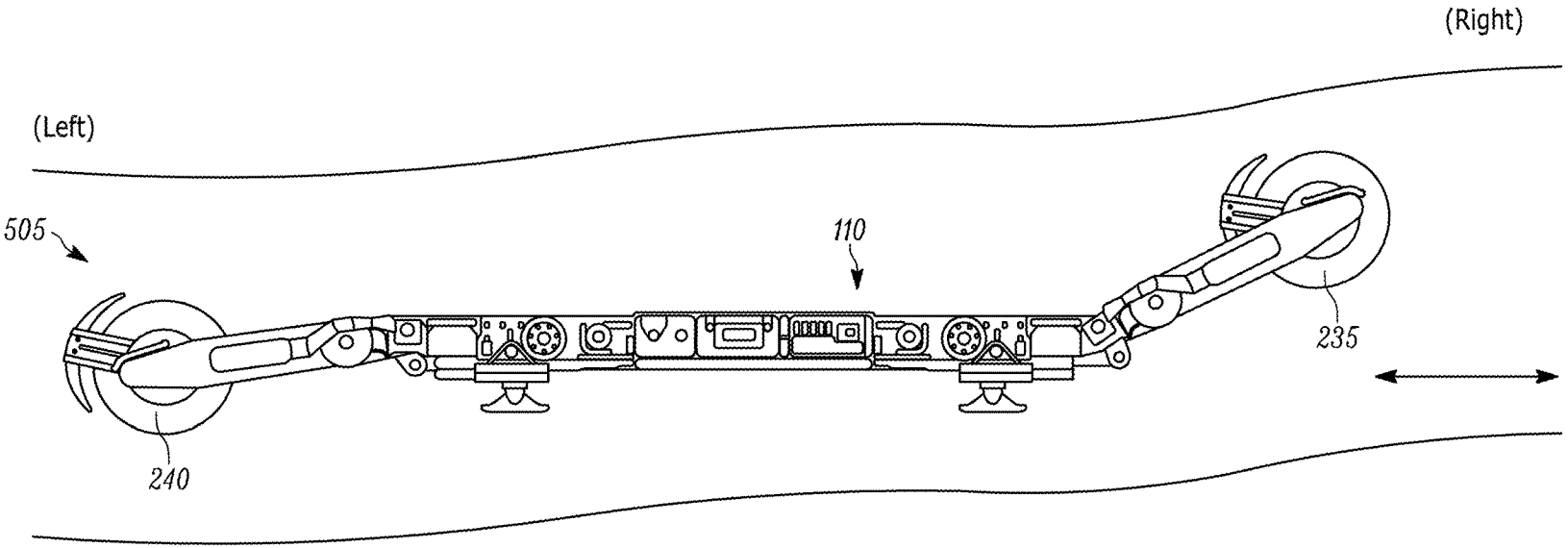
FIGS. 5A-B illustrate a longwall shearer as it passes through a coal seam.
Figure 5B:
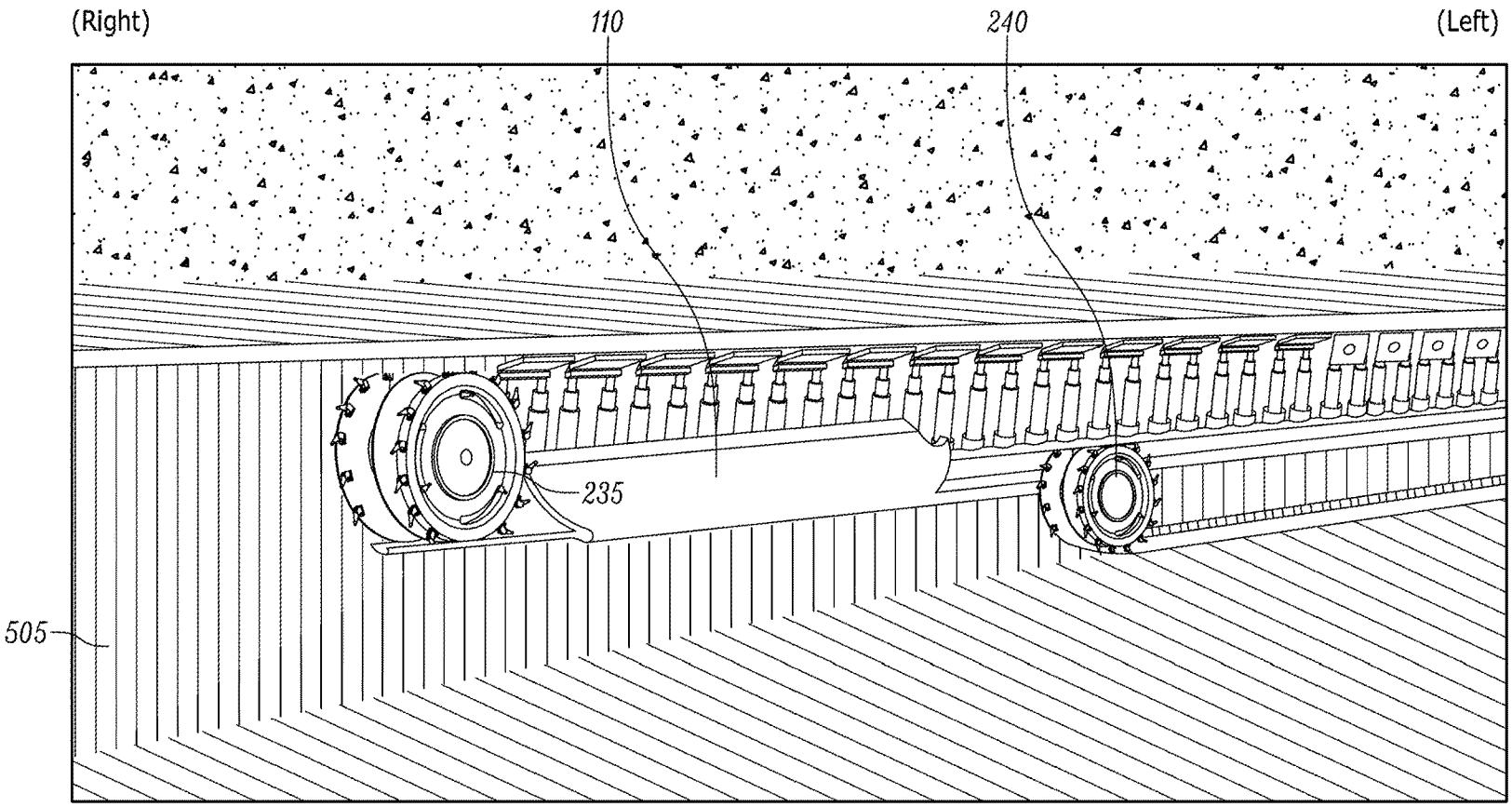

FIG. 5A illustrates the longwall shearer 110 as it passes along the width of a coal face 505. As shown in FIG. 5A, the shearer 110 can displace laterally along the coal face in a bi-directional manner, though it is not necessary that the shearer 110 cut coal bi-directionally, depending on the particular mining operation. For example, in some mining operations, the shearer 110 is capable of hauling bi-directionally along the coal face, but only shears coal in one direction. For example, the shearer 110 may be operated to cut coal over the course of a first, forward pass over the width of the coal face, but not cut coal on its returning pass. Alternatively, the shearer 110 can be configured to cut coal during both the forward and return passes, in a bi-directional cutting operation, for example. FIG. 5B illustrates the longwall shearer 110 as it passes over the coal face 505 from a face-end view. As shown in FIG. 5B, the left cutter 240 and the right cutter 235 of the shearer 110 are staggered to accommodate the full height of the coal seam being mined. In particular, as the shearer 110 displaces horizontally along the AFC 115, the left cutter 240 is shown shearing coal away from the bottom half of the coal face 505, while the right cutter 235 is shown shearing coal away from the top half. It is also configurable for the shearer 110 to shear the full section of the coal face in more than one pass along the coal face, partially extracting the coal on each pass (e.g., shearing coal unidirectionally).

Figure 6:
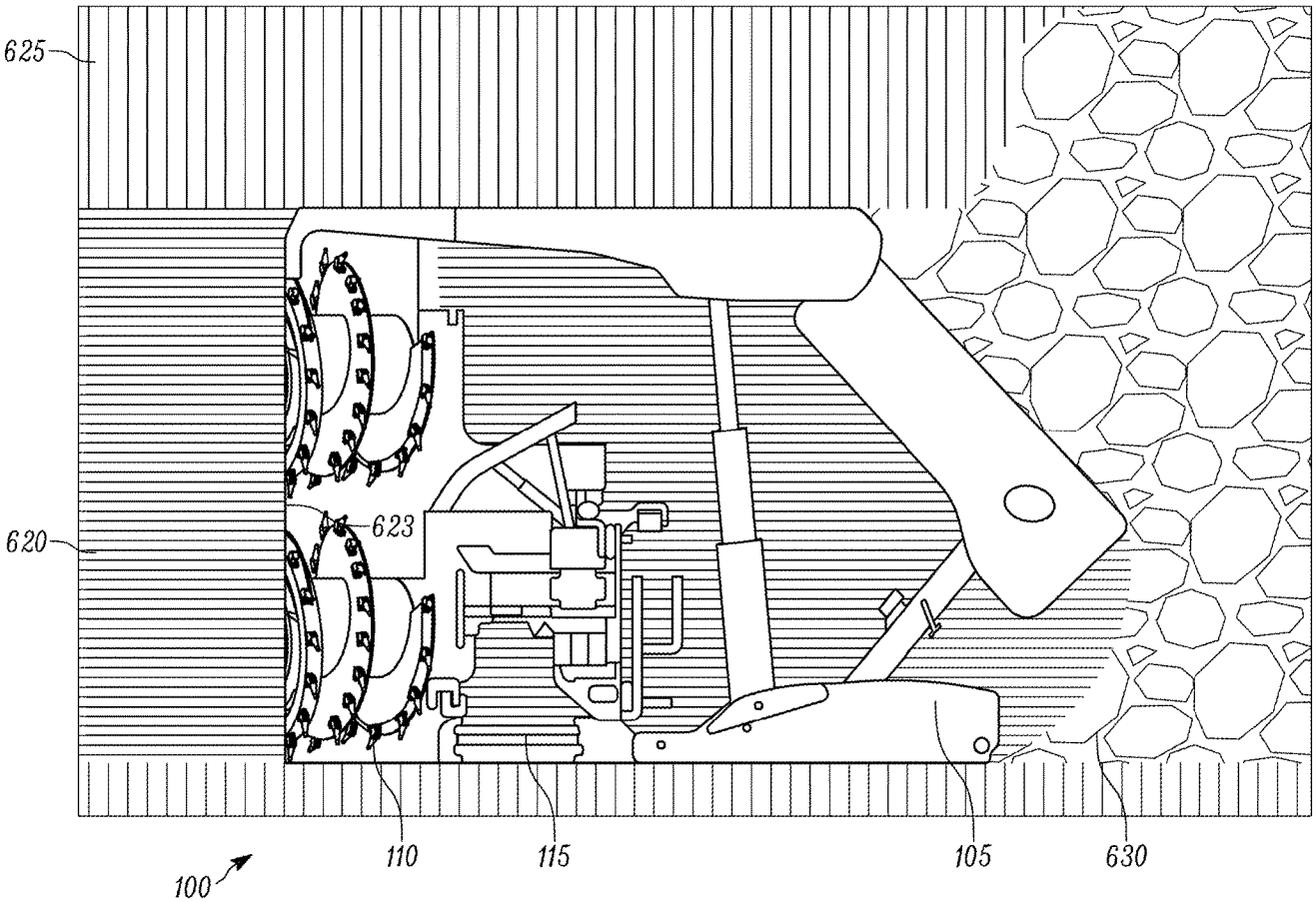
FIG. 6 illustrates collapsing of the geological strata as coal is removed from the seam.

As coal is sheared away from the coal face, the geological strata overlying the excavated regions are allowed to collapse behind the mining system as it advances through the coal seam. FIG. 6 illustrates the mining system 100 advancing through a coal seam 620 as the shearer 110 removes coal from the coal face 623. In particular, the coal face 623 as illustrated in FIG. 6 extends perpendicularly from the plane of the figure. As the mining system 100 advances through the coal seam 620 (to the left, in FIG. 6), the strata 625 is allowed to collapse behind the system 100, forming a goaf 630. Under certain conditions, collapse of the overlying strata 625 can also form cavities, or unequal distributions of strata, above the roof support 105. Cavity formation above the roof support 105 can cause unevenly-distributed pressure over the canopy of the roof support 105 by the overlying strata, which can cause damage to the system 600 and, in particular, the roof support 105. A cavity may sometimes extend forward into the area to be mined causing disruption to the longwall mining process and may result in equipment damage and increased wear rates.

Figure 7:
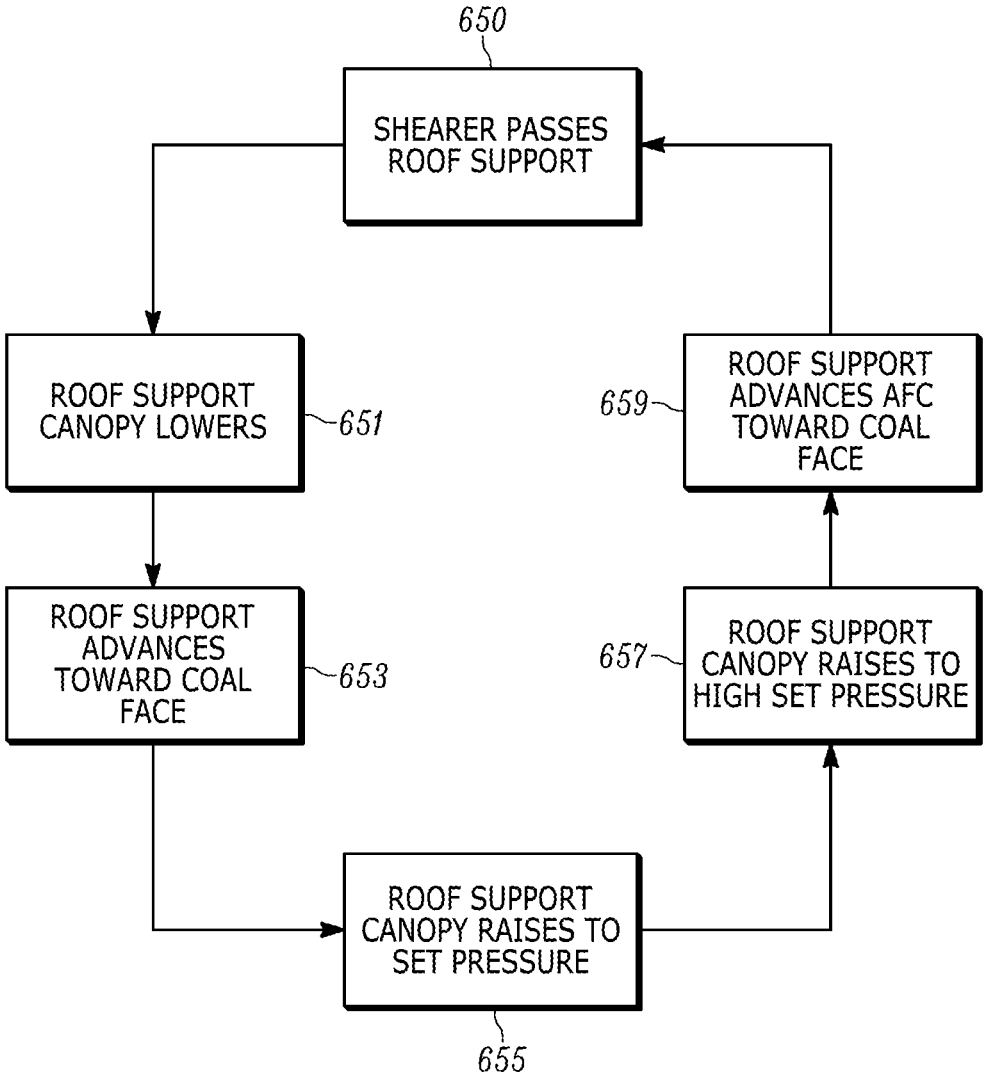
FIG. 7 illustrates an exemplary lower-advance-set cycle for a roof support system.

FIG. 7 illustrates an exemplary lower-advance-set (LAS) cycle that can be used by each of the roof supports 105 as the mining system 100 advances through the coal seam 620. With respect to one of the roof supports 105, at step 650, the shearer 110 passes the roof support 105 while shearing coal away from the coal face 623. The shearer 110 is considered to have passed the roof support 105 after the leading cutter drum 235 or 240 (e.g., the cutter drum cutting the roof horizon or upper part of the coal seam) has cleared the segment of the AFC 115 that is adjacent to the roof support 105. At step 651, the canopy 325 of the roof support 105 lowers by releasing its support leg pressure. The advance ram 235 of the roof support 105 then advances the roof support 105 toward the coal face 623 by a distance approximately equal to the depth of the layer of coal just sheared by the shearer 110. At step 655, after the roof support 105 has been advanced, the canopy 325 of the roof support 105 raises to the newly-exposed roof of the coal seam 620 by increasing the pressure in its support legs. In particular, at step 655, the canopy 325 is raised to just engage with the roof of the coal seam 620, which is achieved by applying a set pressure (e.g., >300 bar) to the support legs 430, 435 of the roof support 105.

The set pressure can be a predetermined or dynamically-calculated value. Further, the time period occurring between canopy 325 lowering (step 651) and achieving set pressure (step 655) can be designated a certain amount of time (e.g., sixty (60) seconds), such that healthy roof support systems can be expected to achieve the set pressure within the specified set time period. At step 657 of the LAS cycle, the canopy 325 is further raised to achieve a high set pressure, which is a pressure applied to the support legs 430, 435 that can cause the canopy 325 of the roof support 105 to exert a pressure on the roof of the coal seam 620, thereby securing the overlying strata in place and/or controlling its movement. As with the set pressure, the high set pressure can be a predetermined or dynamically-calculated value. Further, the time period between canopy lowering (step 651) and achieving high set pressure (step 657) can also be designated a certain amount of time (e.g., ninety (90) seconds), such that healthy roof support systems are expected to achieve the high set pressure within the specified high set time period. The designated amounts of time may also be shorter than an amount of time in which the roof above the roof support 105 would be expected to excessively sag or cave.

At step 659, the advance ram 335 of the roof support 105 pushes the AFC 115 toward the coal face 623. The LAS cycle can then be repeated by the roof support 105 on the next cutting pass of the shearer 110. In general, each roof support 105 along the coal face executes the LAS cycle of FIG. 7 each time the shearer 110 executes a cutting pass.

Figure 8:
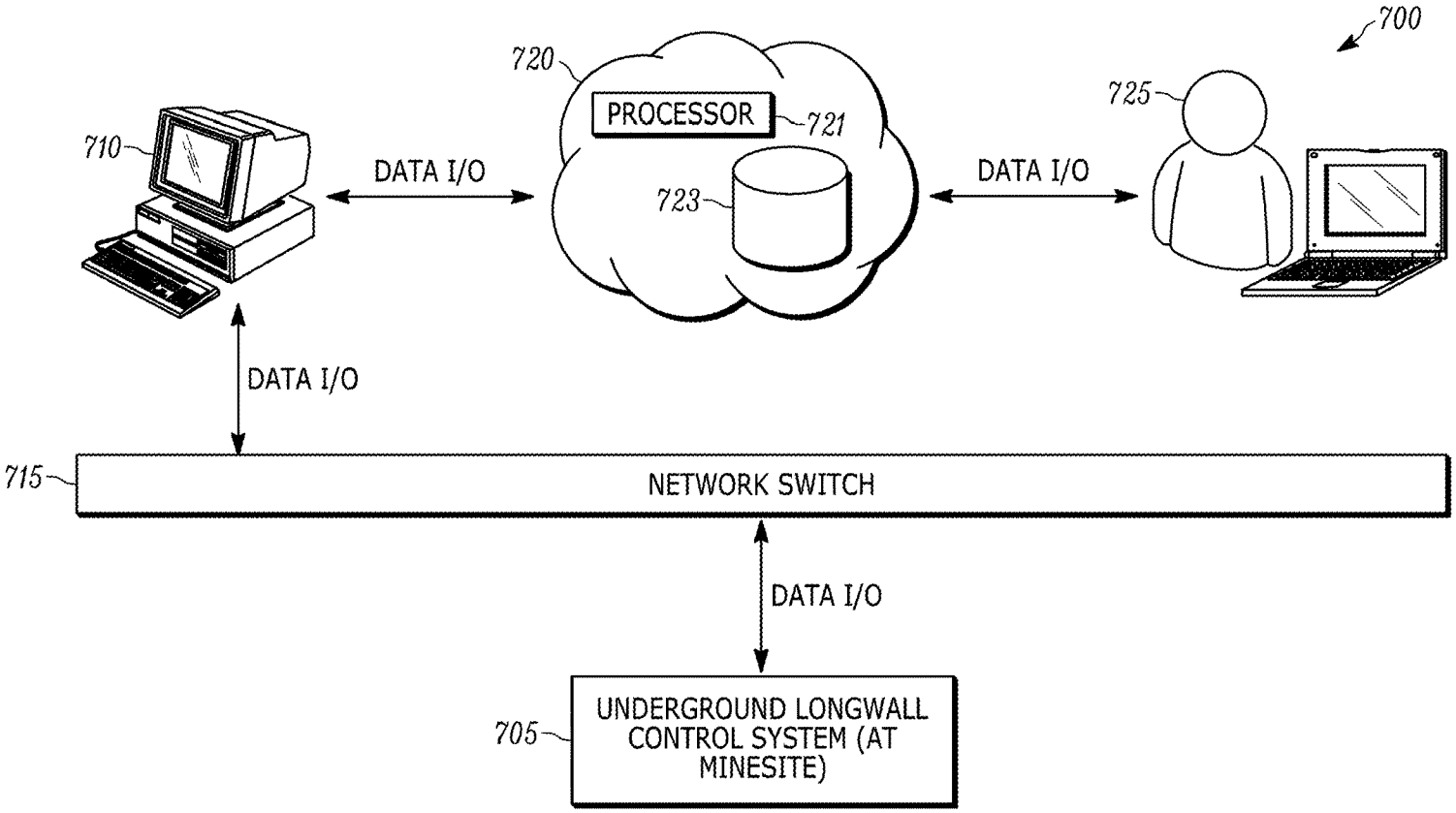
FIG. 8 illustrates a block diagram of a longwall health monitoring system according to one embodiment of the invention.

FIG. 8 illustrates a health monitoring system 700 that can be used to detect and respond to issues arising in various underground longwall control systems 705. The longwall control systems 705 are located at the mining site, and can include various components and controls of the roof supports 105, the AFC 115, the shearer 110, etc. The longwall control systems 705 are in communication with a surface computer 710 via a network switch 715, both of which can also be located at the mine site. Data from the longwall control systems 705 is communicated to the surface computer 710 via the network switch 715, such that, for example, the network switch 715 can receive and route data from the individual control systems of the roof supports 105, AFC 115, and shearer 110. The surface computer 710 is further in communication with a remote monitoring system 720, which can include various computing devices and processors 721 for processing data received from the surface computer 710 (such as the data communicated between the surface computer 710 and the various longwall control systems 705), as well as various servers 723 or databases for storing such data. The remote monitoring system 720 processes and archives the data from the surface computer 710 based on control logic that can be executed by one or more computing devices or processors of the remote monitoring system 720. The particular control logic executed at the remote monitoring system 720 can include various methods for processing data from each mining system component (i.e., the roof supports 105, AFC 115, shearer 110, etc.).

Thus, outputs of the remote monitoring system 720 can include alerts (events) or other warnings pertinent to specific components of the longwall mining system 100, based on the control logic executed by the system 720. These warnings can be sent to designated participants (e.g., via email, SMS messaging, etc.), such as service personnel at a service center 725 with which the monitoring system 720 is in communication, and personnel underground or above ground at the mine site of the underground longwall control systems 705. It should be noted that the remote monitoring system 720 can also output, based on the control logic executed, information that can be used to compile reports on the mining procedure and the health of involved equipment. Accordingly, some outputs may be communicated with the service center 725, while others may be archived in the monitoring system 720 or communicated with the surface computer 710.

Each of the components in the system 700 are communicatively coupled for bi-directional communication. The communication paths between any two components of the system 700 may be wired (e.g., via Ethernet cables or otherwise), wireless (e.g., via a WiFi®, cellular, Bluetooth® protocols), or a combination thereof Although only an underground longwall mining system and a single network switch is depicted in FIG. 8, additional mining machines both underground and surface-related (and alternative to longwall mining) may be coupled to the surface computer 710 via the network switch 715. Similarly, additional network switches 715 or connections may be included to provide alternate communication paths between the underground longwall control systems 705 and the surface computer 710, as well as other systems. Furthermore, additional surface computers 710, remote monitoring systems 720, and service centers 725 may also be included in the system 700.

Figure 9:
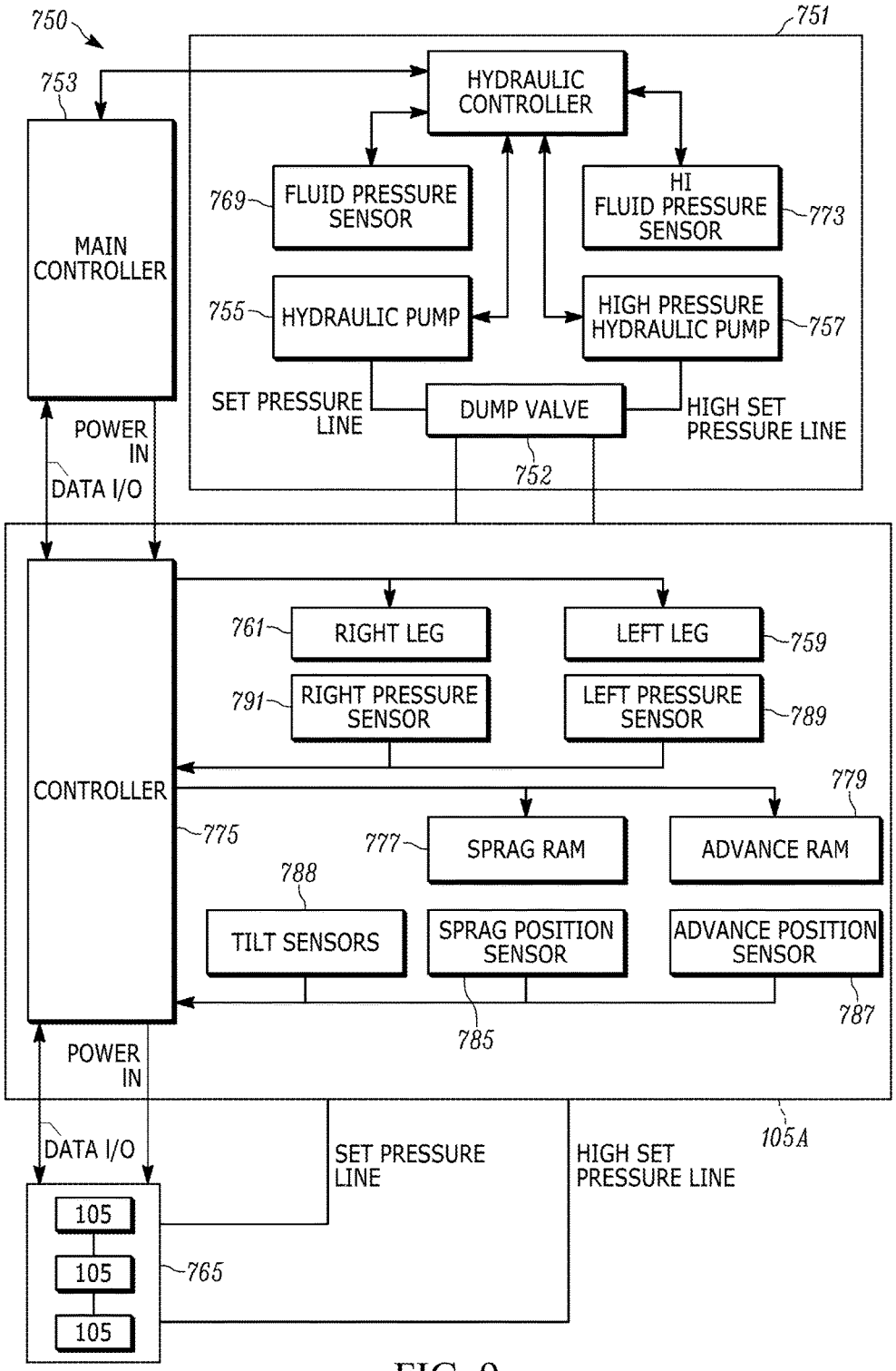
FIG. 9 illustrates a block diagram of a roof support control system according to the system of FIG. 8.

FIG. 9 illustrates a block diagram example of the underground longwall control systems 705, particularly for a roof support system 750 including the roof supports 105. FIG. 9 illustrates one of the roofs supports 105 in particular detail (roof support 105*a*), and the remaining roof supports 105, which are similarly constructed, are labeled additional roof supports 765 and are shown in less detail for each of description and illustration. The system 750 includes a main controller 753, which communicates with a hydraulic pump control system 751, and controls the operation of a dump valve 752, which either delivers hydraulic pressure to the Longwall mining equipment or disperses the pressure safely back to a tank (not shown) if required (e.g., in the event of an emergency stop being operated on the control system). The hydraulic pump 755 provides fluid pressure to left and right legs, 759 and 761 respectively, of the roof support 105*a*, such that the roof support 105*a* can achieve set pressure based on instructions processed by the main controller 753. Similarly, the high pressure hydraulic pump 757 provides high pressure fluid to the left and right legs 759,761 such that each roof support 105*a* can achieve high set pressure. The hydraulic pump 755 and the high pressure hydraulic pump 757 provide hydraulic fluid to each of the left and the right legs 759, 761 of the roof support 105*a*, as well as to additional roof supports 765. In particular, the roof support 105*a* and additional roof supports 765 are electrically interconnected by electrical communications, and hydraulically connected by hydraulic lines originating from the pumps 755,757. The hydraulic pump 755 may have multiple hydraulic lines interconnecting the roof supports 105*a*, 765, while the high pressure hydraulic pump 757 is designated a different set of high pressure hydraulic lines interconnecting the roof supports 105*a*,765. Further, the hydraulic pump 755 has a fluid pressure sensor 769 for providing pressure-related feedback to the main controller 753. Similarly, the high pressure hydraulic pump 757 has a high pressure fluid pressure sensor 773. In some embodiments the high pressure pump 757 may not be utilized. Rather, the hydraulic pump 755 and control system will be configured to provide the prescribed hydraulic pressure.

The main controller 753 is further in communication with controllers associated with the roof supports 105*a*,765, such that the main controller can communicate instructions along the chain of roof supports including LAS cycling instructions, etc. In particular, the main controller 753 can communicate instructions or other data with a controller 775 of the roof support 105*a*. Although the individual roof support controls are herein described with regard to the roof support 105*a*, the additional roof supports 765 share a similar configuration as the roof support 105*a*, and therefore the description of the roof support 105*a* similarly applies to each of the additional roof supports 765. The instructions/data communicated to the controller 775 from the main controller 753 can include instructions for controlling the left and right legs 759,761, though the controller 775 may also control the left and right legs 759,761 based on locally-stored logic (i.e., logic stored to a memory dedicated to the controller 775).

In the illustrated embodiment, the controller 775 is in communication with a sprag ram 777, as well as an advance ram 779, of the roof support 105*a*. In some embodiments, however, the mining system 100 does not include a sprag arm 777. As with controlling the left and right legs 759,761, the controller 775 can control the sprag ram 777 and advance ram 779 based on instructions communicated from the main controller 753 or based on locally-stored instructions/logic. Further, a sprag position sensor 785 is coupled to the sprag ram 777, and provides feedback to the controller 775 indicating a deflection amount of the sprag. Similarly, an advance position sensor 787 is coupled to the advance ram 779 and provides feedback to the controller 775 indicating an extension amount of the advance ram 779 (such as during the roof support advance step in the LAS cycle described with respect to FIG. 7). The roof support 105 also includes tilt sensors 788, such as can be used to provide feedback regarding the tilt of the roof support canopy 325, deflection of the sprag 325, tilt of the base of the shearer 110, tilt of the rear links of the shearer 110, etc.

A left pressure sensor 789 is coupled to the left leg 759 of the roof support 105, while a right pressure sensor 791 is coupled to the right leg 761. The left pressure sensor 789 detects a pressure in the left leg 759 and provides a signal to the controller 775 representative of the measured pressure. Similarly, the right pressure sensor 791 detects a pressure in the right leg 761 and provides a signal to the controller 775 representative of the measured pressure. In some instances, the controller 775 receives real-time pressure data from the pressure sensors 789, 791, as well as real-time position (e.g., inclination) data from one or more sensors such as a sprag position sensor 785, advance position sensor 787, and tilt sensors 788 (referred to collectively as "positioning sensors"). In such instances, the controller 775 can aggregate the data collected by the pressure sensors 789,791 and the positioning sensors 785, 787, 788, and store the aggregated data in a memory, including a memory dedicated to either the controller 775 or the main controller 753. Periodically, the aggregated data is output as a data file via the network switch 715 to the surface computer 710. From the surface computer 710, the data is communicated to the remote monitoring system 720, where it is processed and stored according to control logic particular to handling data from the roof support control system 750. Generally, the data file includes the sensor data aggregated since the previous data file was sent. In the illustrated embodiment, the data file is sent as close to real time as possible (e.g., every second or every time new data points are collected). By receiving the data file in essentially real time, a deficiency in roof support operation can be quickly detected and fixed. In other embodiments, a new data file with sensor data may be sent every fifteen, thirty, or sixty minutes, the data file including sensor data aggregated over the previous fifteen, thirty, or sixty minute window. In some embodiments, the time window for aggregating data can correspond to the time required to complete one shear cycle.

Figure 10A:
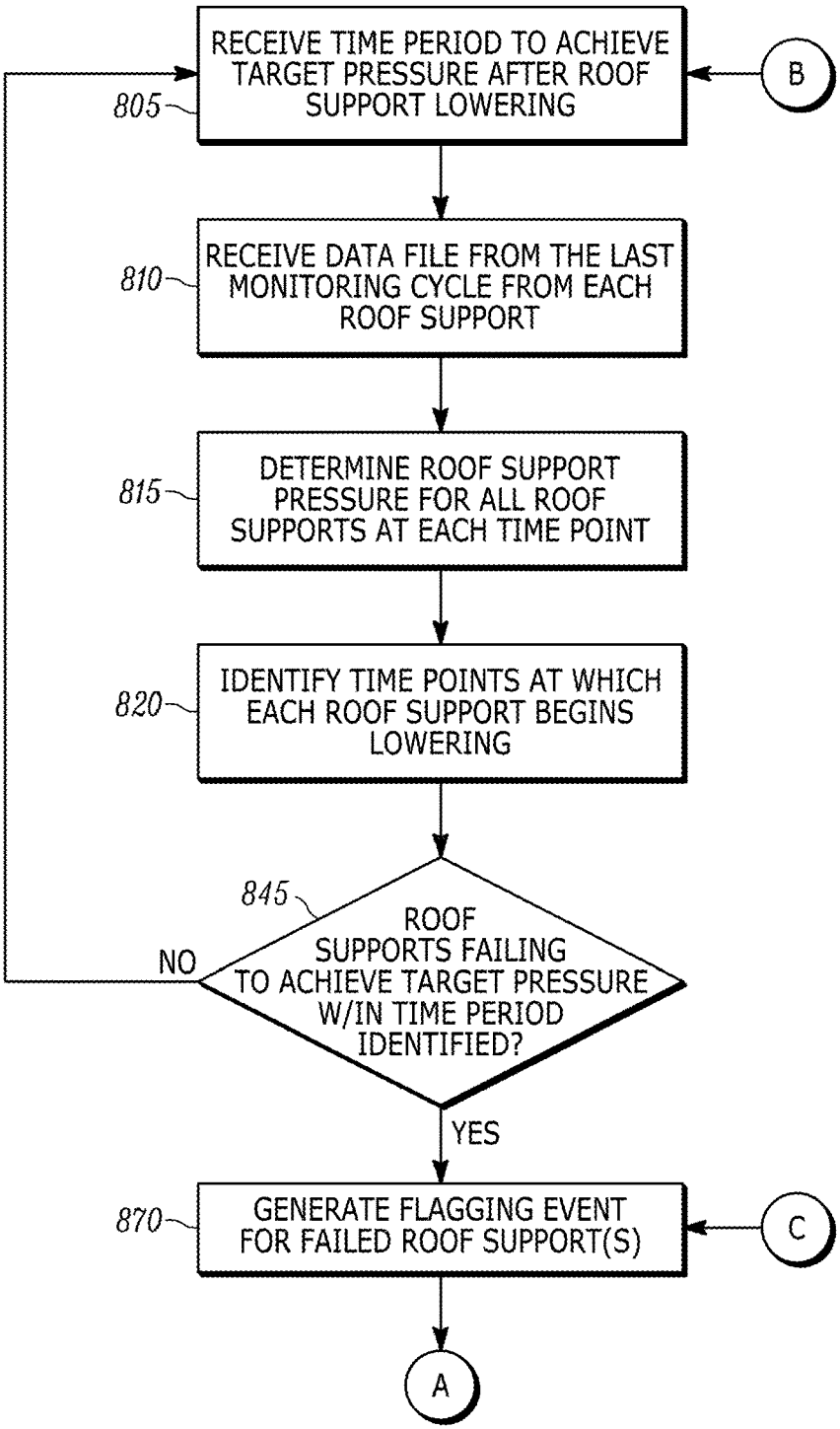
FIGS. 10A-B illustrate exemplary control logic that can be executed by a processor in the system of FIG. 8.

FIGS. 10A and B illustrate exemplary control logic 800 that can be executed by the processor 721 of the remote monitoring system 720 to process and store data files aggregated by the controller 775 per monitoring cycle. As described above with respect to FIG. 9, the duration of the monitoring cycle can be based on a specified time window, the completion of a shear cycle, or a specific time period provided for the roof supports 105 to achieve a given pressure (e.g., set pressure or high set pressure). In the illustrated embodiment, the monitoring cycle can be as short as possible to analyze data as close to real time as possible. Therefore, the processor 721 can be configured to execute the control logic 800 at the completion of each monitoring cycle. However, in some embodiments in which the controller 775 does not aggregate sensor data for the roof support 105, the remote monitoring system 720 may itself be configured to aggregate the data as it is received in real-time from the controller 775. Alternatively, the control logic 800 may be modified for processing each data point as it is received by the remote monitoring system 720. Furthermore, the control logic can be implemented locally at the mine site (e.g., on the main controller 753).

In particular, the control logic 800 can be used by the system 720 to identify and generate alerts for roof supports 105*a*, 765 that failed to achieve a target pressure within a specified time period (after roof support lowering) for achieving the target pressure. For example, if the target pressure for the analysis is the set pressure, the system 720 identifies, based on the control logic 800, those roof supports 105*a*, 765 that failed to achieve the set pressure within the specified time period for achieving set pressure (e.g., 60 seconds). Similarly, if the target pressure is the high set pressure, the system 720 identifies roof supports 105*a*, 765 that failed to achieve the high set pressure within the specified time period for achieving the high set pressure (e.g., 90 seconds). Since high set pressure occurs after set pressure is achieved, the high set time period can be longer than the set time period (e.g., 90 seconds vs. 60 seconds from the canopy lower step 651). More particularly, if the processor 721 runs an analysis for a first target pressure (e.g., the set pressure) as well as a second target pressure (e.g., the high set pressure) using data from the last monitoring cycle, the processor 721 executes the control logic illustrated in FIG. 10A separately for each target pressure analyzed, though both analyses can be executed simultaneously as well as serially. Based on the control logic 800, the system 720 can also identify and generate alerts for conditions in which multiple roof supports 105*a*, 765 failed to achieve the target pressure.

Roof supports 105 can fail to achieve the target pressure for various reasons. For example, if a roof support 105 becomes disconnected from one or more of the set or high set hydraulic lines, the roof support 105 will fail to receive enough fluid to achieve target pressure. Similarly, leaks in the hydraulic lines, faulty valves controlling the hydraulic lines, or faulty or inefficient hydraulic components can also cause roof support pressure failures. Further, pressure failures can occur when multiple roof supports attempt to achieve target pressure at the same time, arising in a high demand for fluid from the pumps 755,757. In some instance, the pumps 755,757 may not be able to supply sufficient fluid to meet the demand such that each of the multiple roof supports 105 achieve their target pressures. Various other reasons can cause pressure failure in roof supports 105, including other faulty or inefficient components not necessarily related to the hydraulic lines.

At step 805 of FIG. 10A, the processor 721 receives a specified time period for achieving the target pressure. At step 810, the processor 721 receives a file of the sensor data aggregated by the main controller 753 for the last monitoring cycle. The aggregated data can include the left and right leg pressures of the roof support 105*a* (as well as the additional roof supports 765), sampled at a particular sampling rate (e.g., every 1 second) throughout the duration of the monitoring cycle, such that each left and right leg pressure value corresponds to a time point within the period of the last monitoring cycle.

At step 815, the processor 721 uses the aggregated pressure data for the left and right legs 759,761 to determine the overall pressure (referred to herein simply as the "pressure") that was achieved by the roof support 105*a* and additional roof supports 765 at each time point. For example, the pressure achieved by the roof support 105*a* is calculated as the average of the pressure achieved by the left leg 759 and that achieved by the right leg 761, for each time point. In the event that one of the left or right legs was leaking or had a faulty transducer, the pressure achieved by the roof support 105*a* for that time point is taken as the pressure achieved by the working leg, given that the pressure sensor coupled to the working leg was also working (i.e., not faulty). However, if both legs 759, 761 of the roof support 105*a* had faulty sensors or were leaking, the pressure data obtained for that roof support is not used, and thus the system 720 does not function for that data. At step 820, the processor 721 uses the calculated roof support pressures for each time point to identify the time points at which the roof support 105*a* was lowered. Similar steps are executed for each additional roof support 765.

Additional logic is utilized to identify and alert to PRS legs 320 that are losing pressure over time and or have a faulty pressure transducer reading. For example, the processor 721 may periodically analyze data over more than one monitoring cycle (e.g., two or three monitoring cycles) to determine whether a specific roof support 105 or group of roof supports 105 shows a pressure trend. The processor 721 may analyze the pressure data for the roof supports 105 over consecutive shear cycles to ensure that a particular roof support or group of roof supports 105 does not slowly lose pressure, which may be indicative of, for example, a growing leak in one of the hydraulic lines. In such embodiments, the processor 721 accesses pressure data for previous monitoring cycles for the same roof support 105 and analyzes the change in pressure over the monitoring cycles. If the processor 721 determines that the same roof support 105 reaches decreasing pressure with monitoring cycles, the processor 721 may generate an alert to the user to indicate that the PRS legs are losing pressure over time. The number of monitoring cycles analyzed by the processor 721 to determine when the PRS legs are losing pressure over time may be based on the number of monitoring cycles completed over one or more shear cycles. Additionally, the processor 721 may also determine whether the pressure sensors 789, 791 function as expected. In such embodiments, the processor 721 may analyze pressure data from previous monitoring cycles and may detect when there is a significant change in pressure readings from a given pressure sensor 789, 791. Such a significant change in pressure readings may be indicative of a faulty sensor. Alternatively, the processor 721 may detect that the pressure readings do not correlate with the function of the PRS legs 320. For example, if the pressure sensor works properly, pressure readings increase as time passes. Therefore, if the processor 721 detects that the pressure readings decrease over time, the processor may determine that the pressure sensor is faulty. In some embodiments, each leg may include repetitive hardware to decrease the effect of a faulty component during operation.

Figure 11:
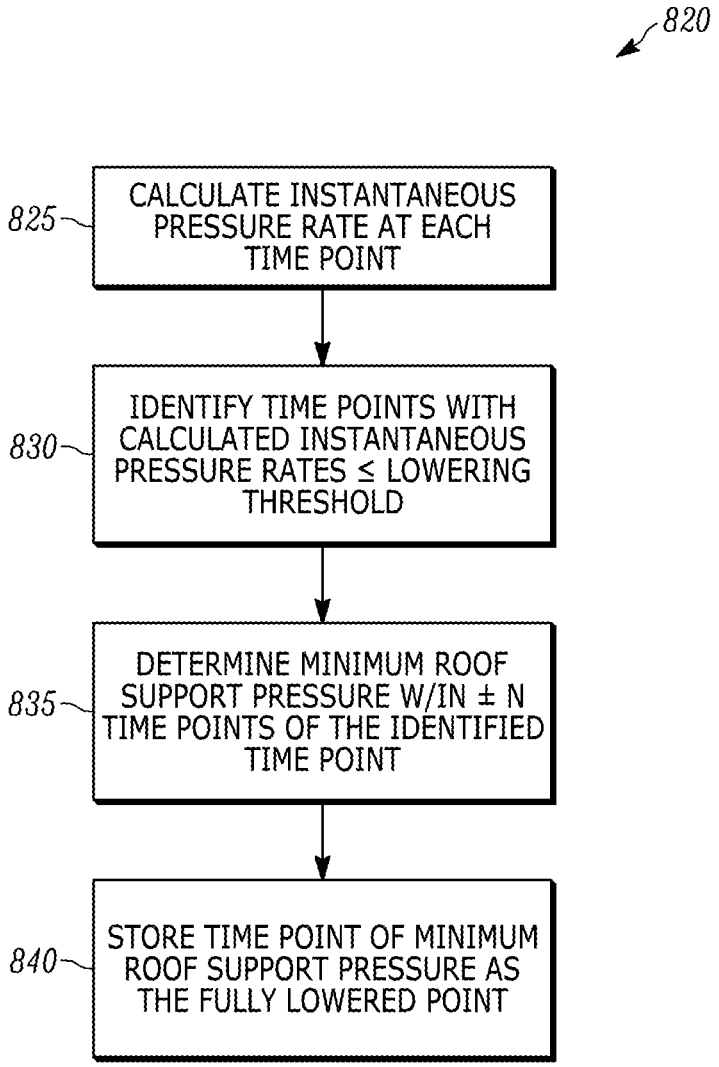
FIGS. 11-12 illustrate additional exemplary control logic that can be executed by a processor in the system of FIG. 8.

FIG. 11 illustrates step 820 in further detail, in that it shows control logic that can be executed by the processor 721 in determining time points at which each of the roof supports 105 (e.g. roof support 105*a*) is lowered (i.e., lowering time points). In particular, at step 825, the processor 721 calculates the instantaneous pressure rate (i.e. the change in pressure over time) of the roof support 105*a* at each time point. For example, the instantaneous pressure rate for one time point can be calculated by taking the difference between the corresponding pressure for that time point and a previous pressure (corresponding to an adjacent or otherwise previous time point), then dividing that difference by the period of time between the two pressures (e.g., 1 second, 5 seconds, 10 seconds, 15 seconds, etc.). At step 830, the processor 721 compares the calculated instantaneous pressure rate at each time point to a predetermined lowering threshold. For example, the lowering threshold can be set to −40 bar/s. If an instantaneous pressure rate at a certain time point is below −40 bar/s, the roof support 105 is considered to have been lowering. At step 835, and for each instantaneous pressure rate below the lowering threshold, the processor 721 determines the minimum pressure achieved by the roof support 105 within a certain window of time. In particular, the window of time is centered on a time point at which the instantaneous pressure rate was determined to be below the lowering threshold (e.g., ±N time points of the determined time point). The window of time (i.e., the ±N time points) can, for example, be a predefined value or a dynamically-calculated value. At step 840, the time point corresponding to the minimum roof support pressure is stored as the point at which the roof support 105 has fully lowered (the identified lowered point).

Figure 12:
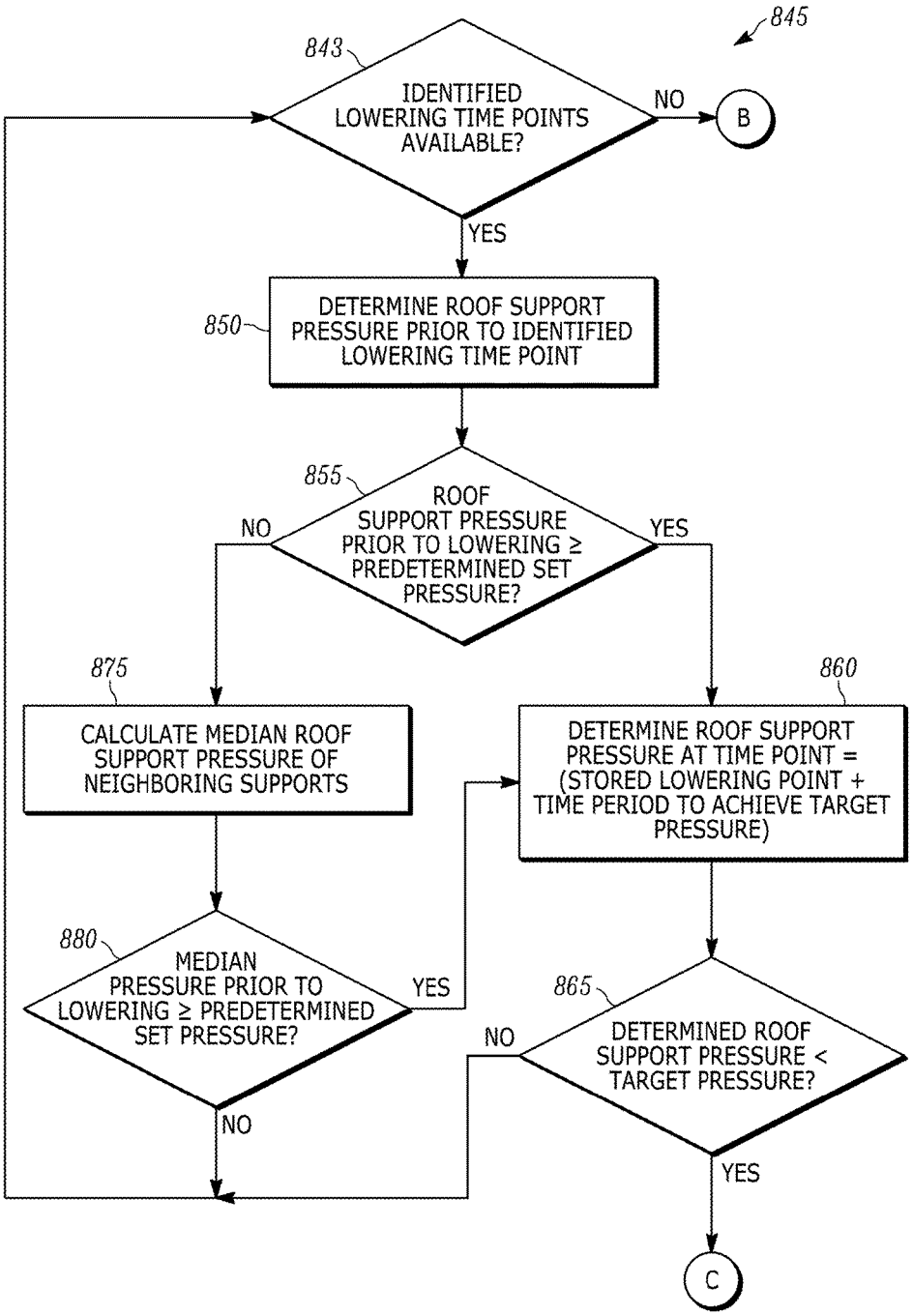

Returning to FIG. 10A, at step 845, the processor 721 determines whether any roof supports 105 failed to achieve the target pressure within the corresponding time period after an identified lowered point. In particular, FIG. 12 illustrates control logic that can be used by the processor 721 in executing step 845. At step 843, the processor 721 checks for any lowered points that were identified. If there are any stored identified lowered points, the processor 721, at step 850, locates the roof support pressure achieved prior to that identified lowered point. In particular, the processor 721 looks back to a previous time point (a certain number of time points distant of the identified lowered point). The processor 721 then stores the corresponding roof support pressure for the previous time point as the pressure achieved prior to lowering. In another embodiment, motor or solenoid activation data may be utilized to define each component of the LAS cycle. For example, turning on a lower solenoid (e.g., the motor that lowers the roof support 105) indicates the start and duration of the lowering component of the LAS cycle. Analogously, turning on an advance solenoid indicates the start and duration of the advance component of the LAS cycle. In other embodiments, other methods for determining the components of the LAS cycle are implemented.

The number of time points to look back (between the identified lowered point and previous time point) can be determined in various ways. For example, if the roof support 105 is expected to have been at set pressure (e.g., 300 bar) n time points previous to the identified lowered point, the number of look back time points can be set to n.

By checking the pressure at the previous time point (e.g., n look back points from the identified lowered point), the processor 721 can determine whether the roof support 105 was able to achieve set pressure during the previous LAS cycle. However, in some embodiments, the processor 721 can look back a certain number of points to check that the roof support 105 was able to achieve other pressures, such as the high set pressure, during the last LAS cycle.

At step 855, the processor 721 compares the identified pressure achieved before lowering with the defined set pressure. If the pressure prior to lowering was greater than or approximately equal to the defined set pressure, then the roof support 105*a* is considered to have been able to achieve set pressure during the last LAS cycle, and the processor 721 proceeds to determine whether the roof support 105*a* achieved the target pressure within the specified time period in the current LAS cycle. At step 860, the processor determines whether the target pressure was achieved within the specified time period by measuring the pressure achieved at a time point equal to the identified lowered point plus the time period specified to achieve the target pressure. If, at step 865, the measured roof support pressure is determined to be less than the target pressure, the processor 721 determines that the roof support 105*a* failed to achieve the target pressure within the specified time period, and generates a flagging event for the roof support 105*a* (step 870 in FIG. 10A). A flagging event is an alert detailing the roof support failure, and can be archived in the remote monitoring system 720 or exported to the service center 725 or elsewhere. For example, the remote monitoring system 720 can archive flagging events to later be exported for reporting purposes. The information transmitted by the flagging event can include identifying information of the particular failed roof support (e.g., a roof support number, roof support type, etc.), as well as the corresponding time point at which the roof support failed to achieve the target pressure, and the determined pressures in steps 850 and 860. If, at step 865, the found roof support pressure is determined to be greater than or equal to the target pressure, the processor 721 returns to step 843 to check for a new identified lowered point.

Returning to step 855 of FIG. 12, if the pressure prior to lowering was less than the defined set pressure, the roof support 105*a* is determined to have failed to achieve the defined set pressure during the last LAS cycle, and the processor 721 proceeds to step 875. At step 875, the processor 721 calculates the median pressure prior to lowering of the neighboring roof supports. The neighboring roof supports are selected based on a predetermined number of roof supports on either side of the roof support 105*a*. If, at step 880, the median pressure prior to lowering was less than the defined set pressure, the roof support 105*a* and its neighbors may have been located beneath a cavity in the strata, and so were unable to achieve set pressure for the expected time point. In this case, the processor 721 returns to step 843 for a new identified lowered point. If, however, at step 880, the median pressure prior to lowering was greater than or equal to the defined set pressure, the processor 721 proceeds to step 860.

Figure 10B:
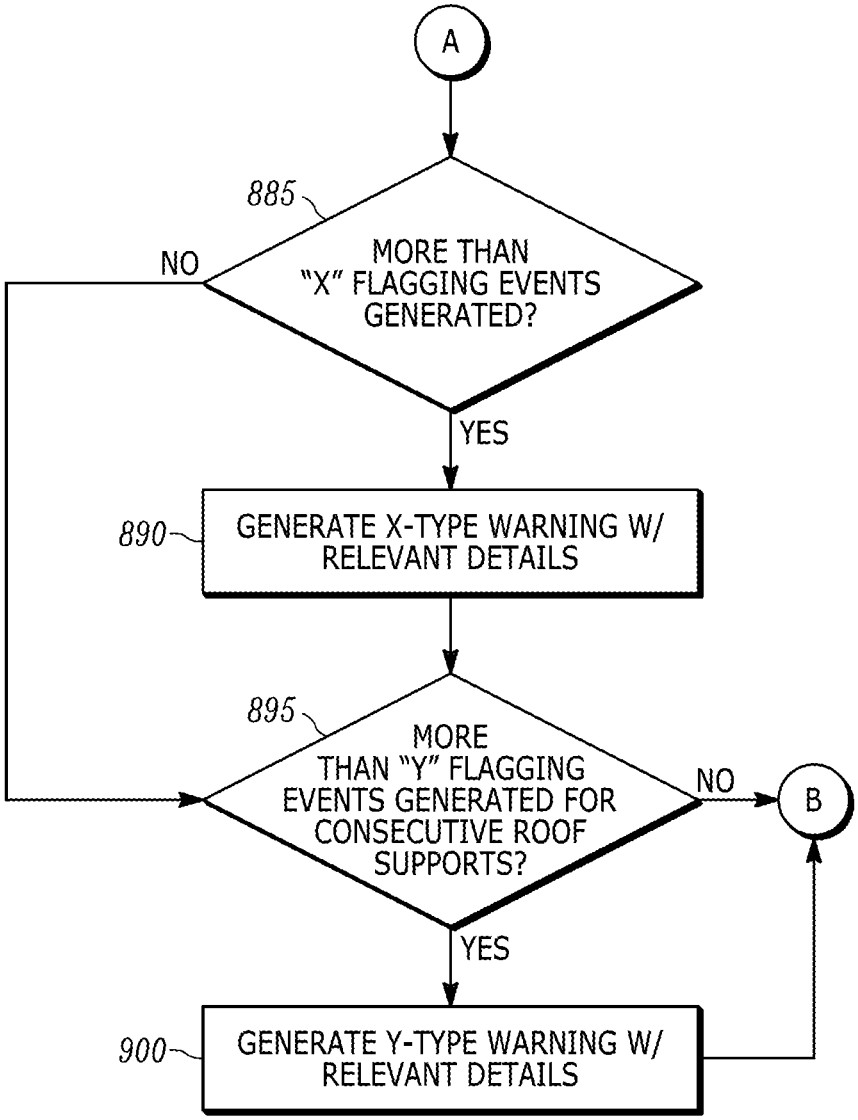

Turning now to FIG. 10B, at step 885, the processor 721 determines if more than a threshold number X of flagging events were generated for the last monitoring cycle specific to a particular target pressure in question, which can indicate that more than a safe number of roof supports are failing to achieve the target pressure, risking caving of the strata and potential damage to the roof support system. If the processor 721 ran an analysis for a first target pressure (e.g., the set pressure) as well as a second target pressure (e.g., the high set pressure) using data from the last monitoring cycle, the processor 721 executes the control logic illustrated in FIG. 10B separately for each target pressure analyzed.

Returning to step 885 of FIG. 10B, if more than X flagging events were generated for the last monitoring cycle, a warning ("X-type warning") is generated at step 890, including details relevant to the multiple failures that generated the flagging events. In some embodiments, such details can include identifying information of the roof supports that the multiple flagging events were generated for, as well as the corresponding time points at which the failures (in achieving the target pressure) were determined to have occurred. Similarly to the flagging events described with respect to FIG. 10A, the X-type warning can be archived in the system 720 or exported to the service center 725 or elsewhere. In some embodiments, the X-type warning can also trigger an alert notification (including emails, phone calls, pages, etc.) that is sent to the service center 725 or other location or personnel as deemed appropriate. For example, the alert notification can include information such as: identifying information of the roof supports that failed to achieve target pressure within the specified time period; the time point of the identified failure to achieve the target pressure; the corresponding actual pressure achieved; identifying information of the particular control logic used to run the analysis; and the start and end times of the analysis.

After generating the X-type warning, the processor 721 proceeds to step 895. If, at step 885, fewer than X flagging events were generated for the last monitoring cycle, the processor 721 also proceeds to 895. At step 895, the processor 721 determines if more than a threshold number Y of flagging events were generated by consecutive roof supports (i.e., consecutive roof supports along the line of roof supports in the system 700) within the last monitoring cycle. If fewer than Y flagging events were generated, the processor 721 proceeds to step 805 of FIG. 10A for a new monitoring cycle and corresponding data file. However, if more than Y flagging events were generated, the processor 721 generates a Y-type warning at step 900. Generating the Y-type warning at step 900 is similar to generating the X-type warning at step 890, except that the Y-type warning includes details specific to the failure of the multiple consecutive roof supports.

Figure 13:
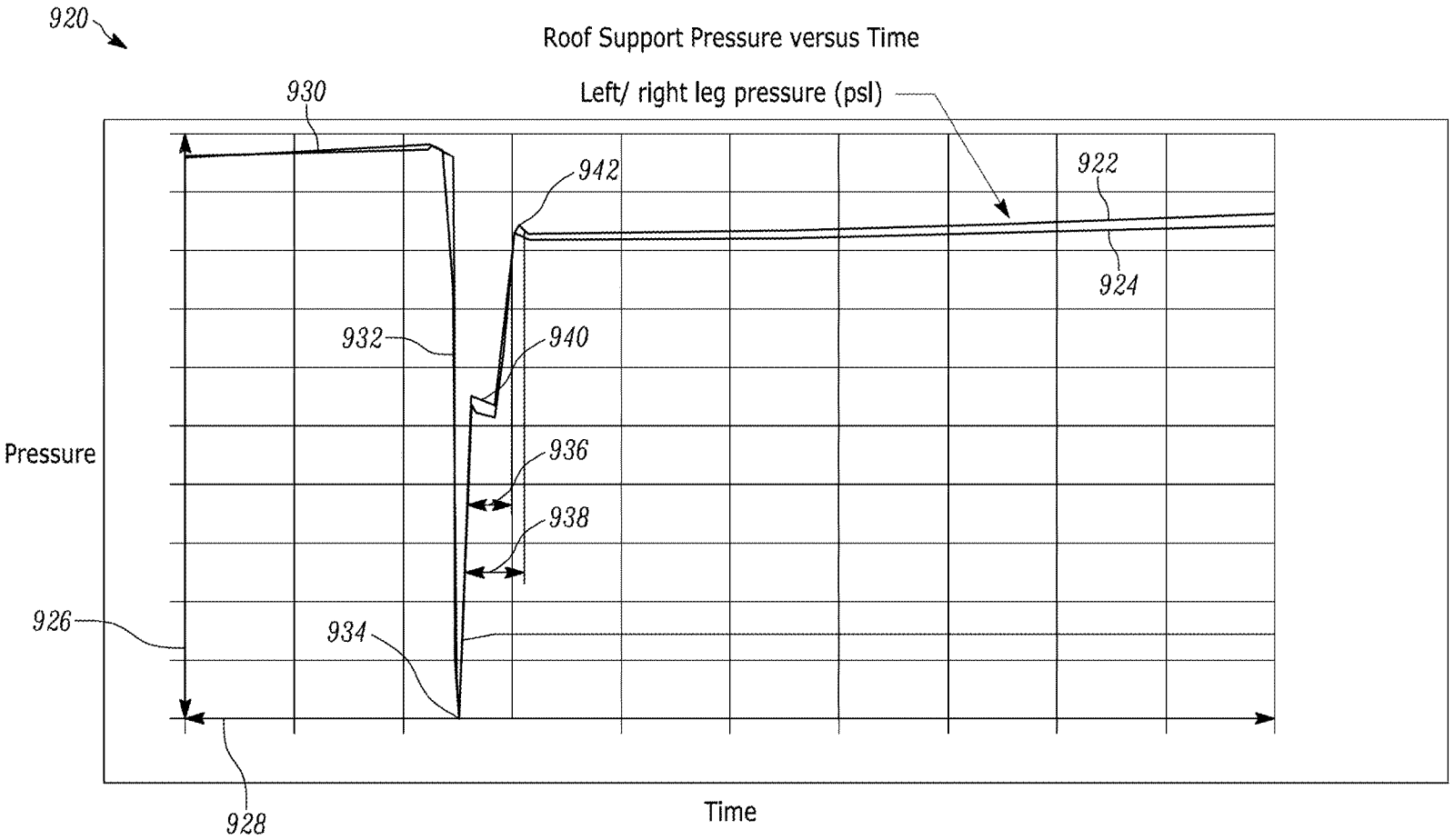
FIG. 13 illustrates a pressure reading for a roof support over time.

FIG. 13 illustrates a pressure reading 920 for the roof support 105*a* over time, such as may be generated based on the aggregated pressure data received by the remote monitoring system 720, for example. The reading 920 displays a right leg pressure-time relationship 922 and a left leg pressure-time relationship 924 on a plot of pressures 926 versus time points 928. As shown in FIG. 13, an initial high set pressure 930 is followed at a later time point by a steep reduction in leg pressure 932. The reduction in leg pressure 932 indicates that the roof support 105*a* is in the lowering stage of the LAS cycle. As described with respect to step 825 in FIG. 11, the reduction in leg pressure 932 can be determined by calculating the instantaneous pressure rate at each time point 928. Following the reduction in leg pressure 932 is a point of minimum pressure 934, indicating that the roof support 105*a* has fully lowered. As described with respect to step 845 in FIG. 11, the point of minimum pressure can be determined by determining the minimum pressure within ±N time points of the time point having an instantaneous pressure rate below threshold. Beyond the point of minimum pressure 934, the LAS cycle continues through the Advance and Set phases within a time period 936 for achieving set pressure and a time period 938 for achieving high set pressure. The roof support 105*a* achieves set pressure at point 940 and achieves high set pressure at point 942. As described with respect to step 845 of FIG. 10A, roof supports that fail to achieve the target pressure (whether set or high set) within the corresponding time period trigger a flagging event.

Figure 14:
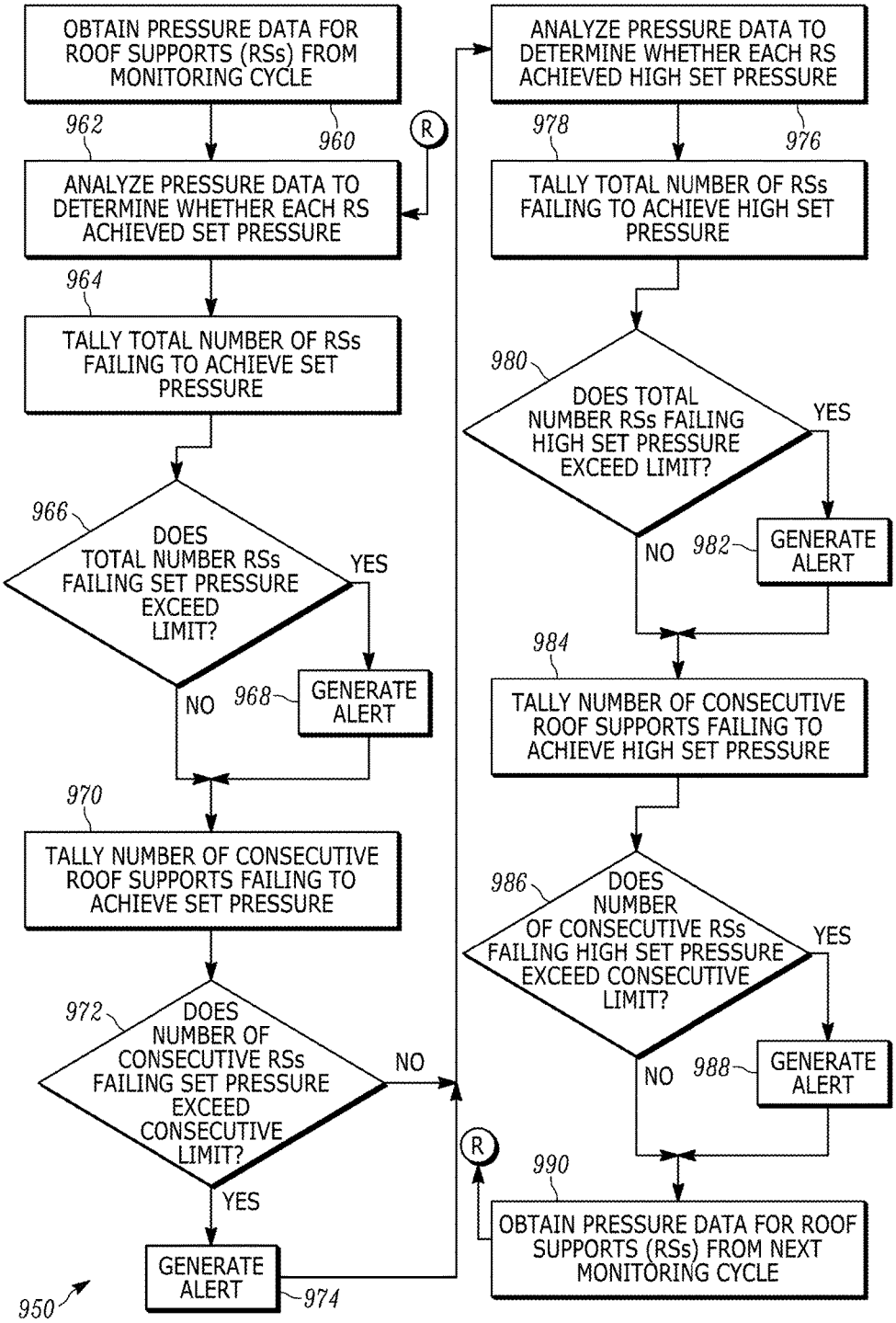
FIG. 14 illustrates a method of monitoring longwall roof supports.
Figure 15:
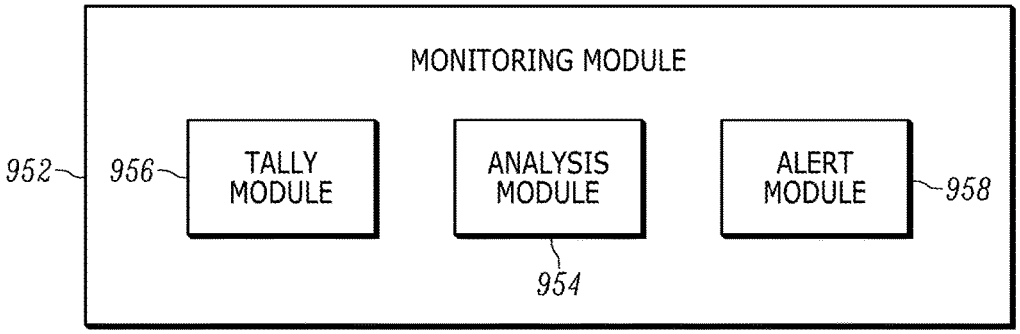
FIG. 15 illustrates a monitoring module operable to implement the method of FIG. 14.

FIG. 14 illustrates a method 950 for execution by a monitoring module 952 of FIG. 15. The monitoring module 952 may be local to the longwall mining system 100 (e.g., underground or aboveground at a mine site) or it may be remote from the longwall system. For instance, the monitoring module 952 may be software, hardware, or a combination thereof, implemented on the remote mining system 720, the surface computer 710, or the main controller 753 to carry out the method 950 of FIG. 14. The monitoring module 952 includes an analysis module 954, a tally module 956, and an alert module 958 (see FIG. 15), whose functionality are described below with respect to the method 950. In some instances, the monitoring module 952 is implemented in part at a first location (e.g., at a mine site) and in part at another location (e.g., at the remote monitoring system 720). For instance, the analysis module 954 may be implemented on the main controller 753, while the tally module 956 and alert module 958 are implemented the remote mining system 720.

Returning to FIG. 14, at step 960, the analysis module 954 obtains the aggregated data file containing the pressure data for the roof supports 105 from the last monitoring cycle. In step 962, the analysis module 954 analyzes the pressure data to determine whether each roof support 105 achieved set pressure in the monitoring cycle. For each instance that a roof support 105 does not achieve set pressure in the monitoring cycle, the analysis module 954 outputs a failing-to-achieve-set-pressure event to the tally module 956. The event includes information regarding the instance of failing to achieve set pressure, including a time stamp, a roof support identifier, roof support location (particularly if not inferable from the roof support identifier), and various details on the particular pressure levels of the roof support during the monitoring cycle.

In step 964, the tally module 956 tallies the total number of roof supports that failed to reach set pressure based on the received events. The tally module 956 further communicates the total number tallied to the alert module 958. In step 966, the alert module 958 determines whether the total number of roof supports that failed to reach set pressure exceeds an alert threshold. If the alert threshold is exceeded, the alert module 958 generates an alert in step 968. For instance, the alert threshold may be set at twenty (20) roof supports. Accordingly, if more than twenty roof supports failed to achieve set pressure during the monitoring cycle, an alert is generated by the alert module 958. In some embodiments, the alert threshold may be set at a percentage of the total roof supports, rather than a specific number. For instance, the alert threshold may be set at 4% of the roof supports. Accordingly, if more than 4% of the total number of roof supports failed to achieve set pressure during the monitoring cycle, an alert is generated by the alert module 958. In some embodiments, the alert threshold may range between four percent (4%) and twenty-five percent (25%) based on the geological conditions of the strata. In some embodiments, the alert threshold may be higher or lower than the range specified above.

After the alert is generated in step 968, or if the alert threshold is determined not to be exceeded in step 966, the monitoring module 952 proceeds to step 970. In step 970, the tally module 956, using the events provided in step 962, tallies the number of consecutive roof supports 105 that failed to achieve set pressure. This tallying takes into account the roof support location information provided or inferred from the event(s) generated by the analysis module 954. Consecutive roof supports refer to an uninterrupted string of roof supports along a coal face. Accordingly, consecutive roof supports failing to achieve set pressure would be a string of two or more roof supports along a coal face that are not interrupted by an intervening roof support that did not fail to set pressure during the monitoring cycle.

In step 972, the alert module 958 determines whether the number of consecutive roof supports failing to achieve set pressure exceeds an alert threshold for consecutive roof supports, such as six (6) consecutive roof supports. If the alert threshold is exceeded, an alert is generated by the alert module 958 in step 974. After the alert is generated in step 974, or if the alert threshold is not exceeded, the monitoring module 952 proceeds to step 976. In some embodiments, the alert threshold for consecutive roof supports may be lower or higher than six (6) consecutive roof supports. For instance, the alert threshold for consecutive roof supports may vary between two (2) and twenty-five (25) based on the geological conditions of the strata. In other words, if the strata is brittle, the alert threshold for consecutive roof supports may be set to two (2), but if the strata is strong, the alert threshold for consecutive roof supports may be set to twenty (20) instead. It may be found that the majority of strata utilize an alert threshold for consecutive roof supports between four (4) and ten (10).

Several consecutive roof supports failing to achieve set or high set pressure would generally pose a more significant issue (e.g., increased likelihood of a roof sagging or collapsing) than the same number of failing roof supports if such failing roof supports were spread out nonconsecutively along the coal face. Accordingly, the alert threshold of step 972 for consecutive roof supports failing to achieve set pressure is generally lower than the alert threshold of step 966 for total roof supports failing to achieve set pressure, which includes both consecutive and nonconsecutive roof supports.

Steps 976-988 generally mimic steps 962-974 described above with respect to set pressure failures, except that steps 976-988 relate to high set pressure failures. In step 976, the analysis module 954 analyzes the pressure data from the monitoring cycle and determines whether each roof support 105 achieved high set pressure. For each instance in which a roof support 105 did not achieve high set pressure during the monitoring cycle, the analysis module 954 outputs a failing-to-achieve-high-set-pressure event to the tally module 956. The event includes information regarding the instance of failing to achieve high set pressure, including a time stamp, a roof support identifier, roof support location (particularly if not inferable from the roof support identifier), and various details on the particular pressure levels of the roof support during the monitoring cycle.

In step 978, the tally module 956 tallies the total number of roof supports that failed to reach high set pressure based on the received events. The tally module 956 further communicates the tallied total number to the alert module 958. In step 980, the alert module 958 determines whether the total number of roof supports that failed to reach high set pressure exceeds an alert threshold (e.g., twenty (20) roof supports). If the alert threshold is exceeded, the alert module 958 generates an alert in step 982.

After the alert is generated in step 982, or if the alert threshold is determined not to be exceeded in step 980, the monitoring module 952 proceeds to step 984. In step 984, the tally module 956, using the events provided in step 976, tallies the number of consecutive roof supports 105 that failed to achieve high set pressure. This tallying takes into account the roof support location information provided or inferred from the event(s) generated by the analysis module 954.

In step 986, the alert module 958 determines whether the number of consecutive roof supports failing to achieve high set pressure exceeds an alert threshold for consecutive roof supports, such as six (6) consecutive roof supports. If the alert threshold is exceeded, an alert is generated by the alert module 958 in step 988. After the alert is generated in step 988, or if the alert threshold is not exceeded, the monitoring module 952 proceeds to step 990.

In step 990, the analysis module 954 obtains another aggregated data file containing the pressure data for the roof supports 105 from the next completed monitoring cycle, and loops back to step 962. Accordingly, the method 950 is executed at least once for each monitoring cycle. In some instances, the aggregated data file obtained in steps 960 and 990 includes multiple monitoring cycles and the method 950 is repeated for a particular data file to separately consider each monitoring cycle making up the data file.

Although the steps of method 950 are illustrated as occurring serially, one or more of the steps are executed simultaneously in some instances. For example, the analyzing steps 962 and 976 may occur simultaneously, the tallying steps 964, 970, 978, and 984 may occur simultaneously, and the alert generation steps 968, 974, 982, and 988 may occur simultaneously. Furthermore, the steps of method 950 may be executed in another order. For instance, the analyzing steps 962 and 976 may occur first (simultaneously or serially), followed by the tallying steps 964, 970, 978, and 984 (simultaneously or serially), and then the alert generation steps 968, 974, 982, and 988 (simultaneously or serially).

Figure 16A:
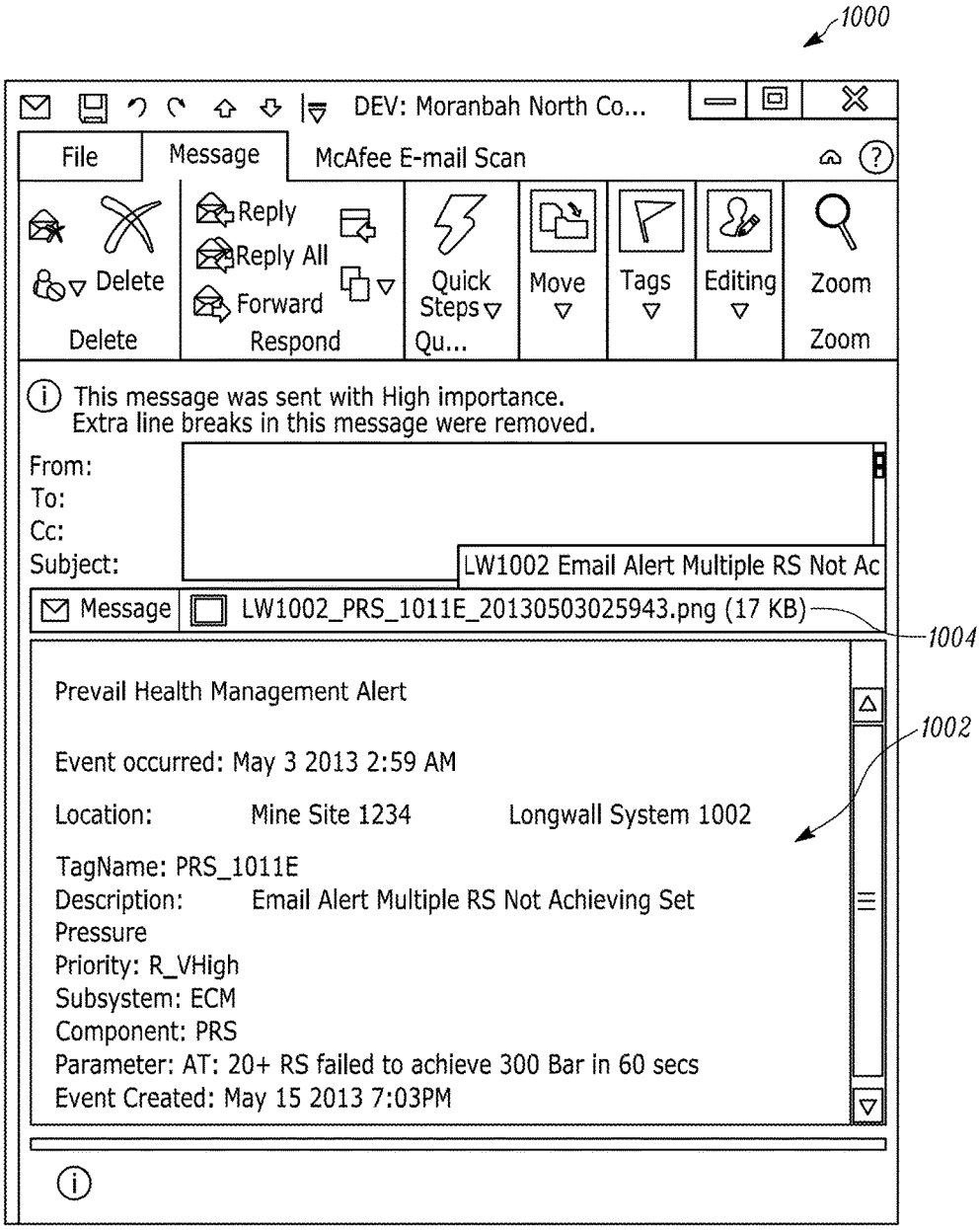
FIG. 16A-B illustrate an alert email and roof support graphs, respectively.

As noted above, the alert module 958 generates an alert in steps 968, 974, 982, and 988. Although the alert may take several forms (e.g., via email, SMS messaging, etc.), FIG. 16A illustrates an example email alert 1000 that may be sent out to one or more designated participants (e.g., service personnel at a service center 725, personnel underground or above ground at the mine site, etc.) The email alert 1000 includes text 1002 with general information about the alert, including when the event occurred, a location of the event, an identifier of the alert type ("tagname"), a description of the alert type, a priority level, an indication of the subsystem in which the event occurred and the relevant component(s) (e.g., powered roof supports), a parameter violated (e.g., more than twenty roof supports 105 failed to achieve set pressure (300 Bar) in 60 seconds), and when the event/alert was created.

Figure 16B:
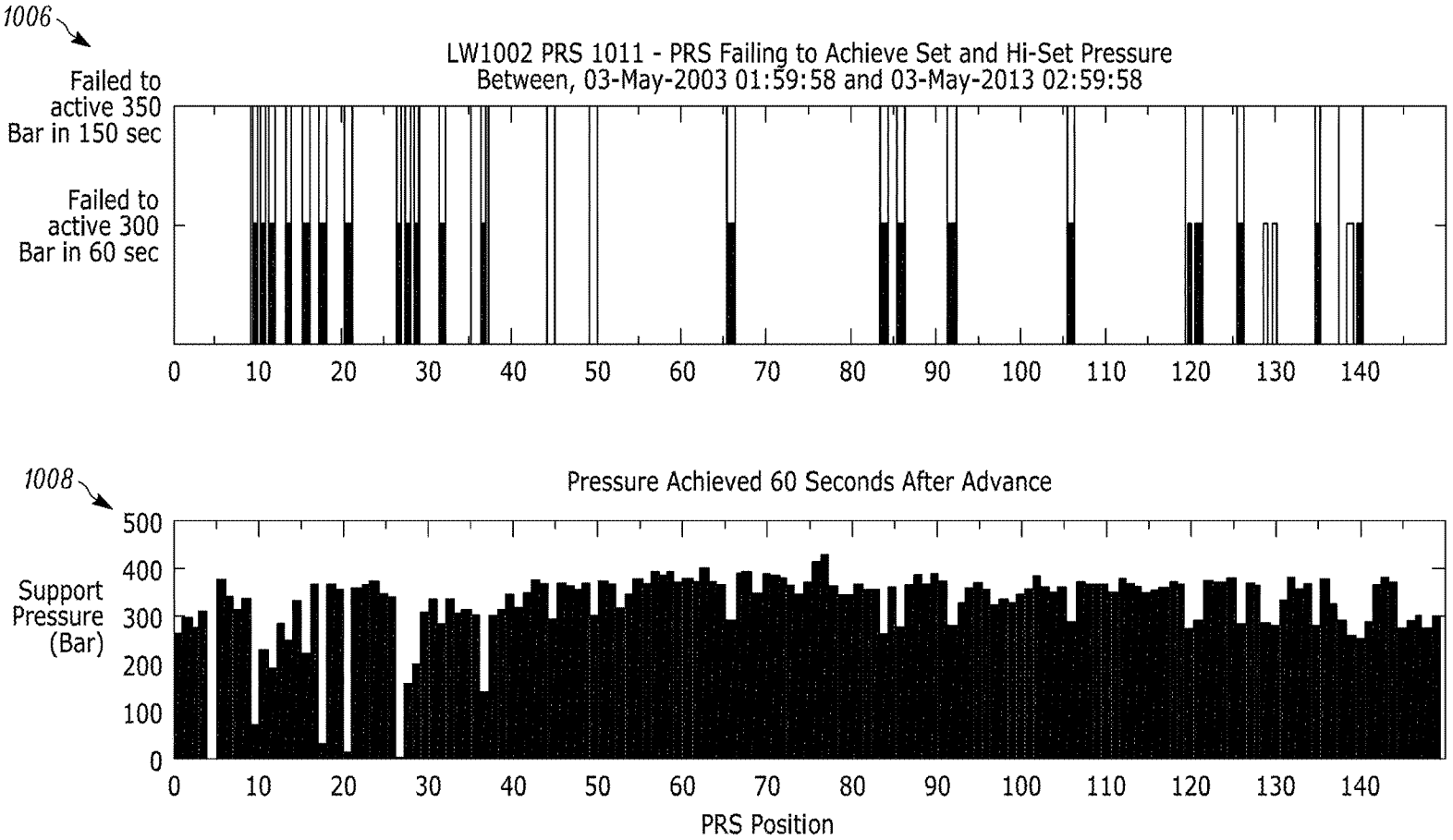

Also included with the email alert 1000 is an attached image file 1004, in this case, a Portable Network Graphics (.png) file, including a graphic depiction to assist illustration of the event or scenario causing the alert. FIG. 16B illustrates the contents of the image file 1004, which includes two graphs: a roof support failure graph 1006 and a roof support pressure graph 1008. The roof support failure graph 1006 includes an x-axis with each x-point representing a different roof support 105 of the mining system 100, and a y-axis with three points: no failure, failure to achieve set pressure, and failure to achieve high set pressure. Thus, in graph 1006, if no bar is shown rising off the x-axis in the y-direction for a particular roof support, then no pressure failure occurred. However, if a bar of a first color rises halfway up in the y-direction, the associated roof support failed to achieve set pressure. Finally, if a bar of a second color rises in the y-direction to the top of the graph 1006, then the associated roof support failed to achieve high set pressure.

The roof support pressure graph 1008 includes the same x-axis as the graph 1006 with each x-point representing a different roof support 105, but the y-axis is a pressure measurement in Bar). The graph 1008 indicates, for each roof support 105, the pressure achieved at the time to set alert threshold. With the graphs 1006 and 1008, an individual is able to quickly assess pressure issues for the roof supports 105.

In some instances, a generated alert takes another form or includes further features. For instance, an alert generated by the alert module 958 may also include an instruction sent to one or more components of the longwall mining system 100 (e.g., to the roof supports 105, longwall shearer 110, AFC 115, AFC drives 120, etc.) to safely shut down.

Additionally, alerts generated by the alert module 958 may have different severity levels depending on the particular alert (e.g., depending on whether the alert is generated in step 968, 974, 982, or 988). Additionally, the alert module 958 may have multiple alert thresholds for each of steps 966, 972, 980, and 986, such as a warning threshold (e.g., five roof supports), an medium alert threshold (e.g., ten roof supports), and a high alert threshold (e.g., twenty roof supports), and the severity of the alerts generated depends on which of the thresholds is exceeded. Generally, the higher the alert threshold, the more severe the alert. Thus, a low severity level alert may be a notification included as part of a daily report; a medium severity level may include an email or other electronic notification to on-site personal; and a high severity level alert may include an automatic shutdown of one or more components of the longwall mining system 100. It is also noted that alerting thresholds may change according to local mine geological conditions. For example, when the longwall is close to geological faults and fissures tighter boundaries may be set to ensure roof support set performance and to avoid strata failure above the longwall mining system.

It should be noted that one or more of the steps and processes described herein can be carried out simultaneously, as well as in various different orders, and are not limited by the particular arrangement of steps or elements described herein. In some embodiments, in place of pressure sensors 789,791, another sensor or technique can be used to determine the pressures of the left and right legs 759,761. Furthermore, in some embodiments, the system 700 can be used by various longwall mining-specific systems, as well as by various other industrial systems not necessarily particular to longwall or underground mining.

It should also be noted that as the remote monitoring system 720 runs the analyses described with respect to FIGS. 10A-B-12 and 14, other analyses, whether conducted on roof support system data or other longwall component system data, can be executed by either the processor 721 or other designated processors of the system 720. For example, the system 720 can run analyses on monitored parameters (collected data) from other components of the roof support system 750. In some instances, for example, the remote monitoring system 720 can analyze data collected from the main hydraulic lines (lines coming from the pumps 755,757) and generate alerts of pressure-related faults determined for one or more of the lines. Such faults could include a failure to maintain particular pressures associated with each line, a failure to maintain a particular flow rate, etc. In other instances, the remote monitoring system 720 can also analyze data collected from one or more transducers associated with various components of the roof support system 750. For example, the remote monitoring system 720 can analyze data collected from the left and right leg pressure sensors 789,791 to determine if one or more of the sensors have been failing to detect accurate data or where legs are leaking or losing pressure (possibly based on data collected by sensors that are known to be working from neighboring roof supports, or based on other data collected from various components and transducers of the roof support system 750). Similarly, the remote monitoring system 720 can determine such failures and generate alerts detailing the failure.

Thus, the invention provides, among other things, systems and methods for detecting and responding to failure of a roof support in a longwall mining system. Various features of the invention are set forth in the following claims.

What is claimed is:

1. A method of monitoring a roof support of a longwall mining system, the method comprising:

obtaining, with an electronic processor, pressure information for the roof support;

determining, with the electronic processor, whether the pressure information is indicative of a first type of pressure failure of the roof support by determining whether the roof support achieved set pressure within a first predetermined amount of time;

determining, with the electronic processor, whether the pressure information is indicative of a second type of pressure failure of the roof support, the second type of pressure failure being different than the first type of pressure failure; and generating, with the electronic processor, an alert in response to determining that the pressure information is indicative of at least one selected from the group consisting of the first type of pressure failure and the second type of pressure failure.

2. The method of claim 1, wherein determining whether the pressure information is indicative of the second type of pressure failure includes determining whether the roof support achieved high set pressure within a second predetermined amount of time.

3. The method of claim 2, wherein the second predetermined amount of time is longer than the first predetermined amount of time.

4. The method of claim 3, wherein the second predetermined amount of time is shorter than an expected amount of time in which strata above the roof support is expected to cave.

5. The method of claim 1, wherein obtaining pressure information includes obtaining a plurality of pressure measurements over a predetermined monitoring cycle, and further comprising:

identifying, with the electronic processor, a minimum pressure achieved by the roof support over the monitoring cycle, and determining, with the electronic processor, that the roof support is in a lowered position when the pressure information is at the minimum pressure.

6. The method of claim 5, wherein determining whether the pressure information is indicative of the first type of pressure failure includes determining whether the roof support achieved a target pressure within a predetermined amount of time after the roof support achieves the minimum pressure.

7. The method of claim 5, further comprising receiving, with the electronic processor, an indication of whether a lowering motor of the roof support is activated, and wherein determining that the roof support is in the lowered position includes determining that the roof support is in the lowered position based on the indication.

8. The method of claim 1, wherein the pressure information includes pressure information obtained over a current shear cycle, and further comprising:

accessing, with the electronic processor, pressure information obtained over a previous shear cycle, comparing, with the electronic processor, pressure information obtained over the previous shear cycle with pressure information obtained over the current shear cycle, and generating, with the electronic processor, a second alert based on comparing the pressure information obtained over the previous shear cycle with the pressure information obtained over the current shear cycle.

9. A monitoring device for a longwall mining system having a roof support including a pressure sensor to determine pressure levels of the roof support, the monitoring device comprising:

a memory; and an electronic processor coupled to the memory and in communication with the pressure sensor to receive pressure information for the roof support, the electronic processor configured to:

determine whether the pressure information is indicative of a first type of pressure failure based on whether the roof support achieved set pressure within a predetermined amount of time, determine whether the pressure information is indicative of a second type of pressure failure, the second type of pressure failure being different than the first type of pressure failure, and generate an alert in response to determining that the pressure information is indicative of at least one selected from the group consisting of the first type of pressure failure and the second type of pressure failure.

10. The monitoring device of claim 9, wherein the second type of pressure failure is based on whether the roof support achieves high set pressure with a second predetermined amount of time.

11. The monitoring device of claim 10, wherein the second predetermined amount of time is longer than the first predetermined amount of time.

12. The monitoring device of claim 9, wherein the pressure information is based on an average pressure calculated from a first pressure measurement of a right leg of the roof support and a second pressure measurement of a left leg of the roof support.

13. The monitoring device of claim 9, wherein the pressure information includes a plurality of pressure measurements obtained over a predetermined monitoring cycle, and wherein the electronic processor is configured to:

identify a minimum pressure achieved by the roof support, and determine that the roof support is in a lowered position when the pressure information is at the minimum pressure.

14. The monitoring device of claim 13, wherein the electronic processor is configured to determine that the pressure information is indicative of the first type of pressure failure when the roof support fails to achieve a target pressure within a predetermined amount of time after the roof support achieves the minimum pressure.

15. The monitoring device of claim 9, wherein the pressure information includes pressure information obtained over a current shear cycle, and wherein the electronic processor is configured to:

access pressure information obtained over a previous shear cycle, compare the pressure information obtained over the previous shear cycle with the pressure information obtained over the current shear cycle, and generate a second alert based on the comparison between the pressure information obtained over the previous shear cycle with the pressure information obtained over the current shear cycle.

16. The monitoring device of claim 9, wherein the alert is a first type of alert when the pressure information is indicative of the first type of pressure failure, and wherein the electronic processor is configured to generate a second type of alert when the pressure information is indicative of the second type of pressure failure, the second type of alert being different than the first type of alert.

* * * * *